US006647204B1

(12) United States Patent
Hutchinson

(10) Patent No.: US 6,647,204 B1
(45) Date of Patent: Nov. 11, 2003

(54) PORTABLE STEAM GENERATING SYSTEM

(75) Inventor: Harold D. Hutchinson, Oxnard, CA (US)

(73) Assignee: Harwil Corporation, Oxnard, CA (US)

( * ) Notice: Subject to any disclaimer, the term of this patent is extended or adjusted under 35 U.S.C. 154(b) by 0 days.

(21) Appl. No.: 10/339,923

(22) Filed: Jan. 9, 2003

Related U.S. Application Data

(63) Continuation-in-part of application No. 10/150,168, filed on May 16, 2002, and a continuation of application No. 09/801,240, filed on Mar. 7, 2001, now Pat. No. 6,393,212, and a continuation of application No. 09/438,851, filed on Nov. 12, 1999, now abandoned, and application No. 09/370,303, filed on Aug. 9, 1999, now abandoned, which is a continuation-in-part of application No. 09/044,084, filed on Mar. 18, 1998, now abandoned.

(51) Int. Cl.[7] ..... F24H 1/10

(52) U.S. Cl. ..... 392/491; 15/320; 134/22.05

(58) Field of Search ..... 392/491, 465, 392/471, 485, 449; 15/300, 320, 321; 134/322, 10, 21, 22.15

(56) References Cited

U.S. PATENT DOCUMENTS 4,308,636 A * 1/1982 Davis ..... 15/321
4,696,074 A * 9/1987 Cavalli ..... 15/321
5,613,271 A * 3/1997 Thomas ..... 15/321
5,815,869 A * 10/1998 Hopkins ..... 8/158
6,148,144 A * 11/2000 Milanese ..... 392/405

* cited by examiner

*Primary Examiner*—Thor Campbell
(74) *Attorney, Agent, or Firm*—David O'Reilly

(57) ABSTRACT

A small portable steam generating system comprised of an elongate cylindrical cylinder having a turbulent baffle circulation system. The steam generator includes a plurality of baffles, having alternating ports spaced along the length of the cylinder. The baffles have ports offset at 180° respectively to each other to provide turbulent flow that speeds up and slows down as it passes through the ports. The series of baffles in the elongate cylinder are mounted around a centrally located heater. The surfaces and ports in the baffles, positioned along the elongate cylinder and heater body, form a diffused turbulent flow of variable length and time as it passes from an input to an output. The steam generating system described herein is fitted with a steam water droplet separation system plus a high pressure steam superheater fitted to an exit tube and a non-conductive high temperature tube for transporting super-heated steam to a surface cleaning applicator. The system also includes a practical application for steam cleaning, scrubbing, vacuuming debris and sanitizing. The steam generator is mounted in a compact portable housing connected to an applicator that has steam outlet parts, a vacuuming manifold; sanitizing UV lamps and brushes for simultaneously scrubbing a surface being cleaned.

30 Claims, 21 Drawing Sheets

318
319
319
320
312
386
314
388
376
384
374
384
390
390
34
34
394
394
396
392
392
404
382
33
33
398
400
385
378
380
385
396

PORTABLE STEAM GENERATING SYSTEM

This application is a Continuation-In-Part of application Ser. No. 10/150,168, filed May 16, 2002, and Continuation of application Ser. No. 09/801,240, filed Mar. 7, 2001, now U.S. Pat. No. 6,393,212, and Continuation of application Ser. No. 09/438,851, filed Nov. 12, 1999 now abandoned, and application Ser. No. 09/370,303 filed Aug. 9, 1999 now abandoned, which in turn is a Continuation-In-Part of application Ser. No. 09/044,084 filed Mar. 18, 1998 now abandoned.

BACKGROUND OF THE INVENTION

1. Field of the Invention

This invention relates to steam generators and more particularly, relates to a compact, small volume steam generating system and surface steam cleaning and sanitation system.

2. Background Information

Portable steam generating systems are used for steam cleaning in restaurant kitchens, hotel/motel bathrooms, public bathrooms, rest homes, hospitals, dental offices and related human services facilities. They are also used in industry for cleaning dirty and contaminated surfaces of oil and grease, and also for steam cleaning vehicle engines. Steam generating systems are also used for the removal of paint, wallpaper, graffiti, etc.

Heavy duty steam cleaning equipment has been available for many years for heavy and medium cleaning. However, a lengthy and in-depth study revealed almost a complete lack of small, portable, lightweight, low capacity steam cleaning equipment for small items and limited surface areas in confined spaces. To date, only a few foreign and United States companies supply such equipment.

The only U.S. producer of a low capacity steam cleaner was found to be a system that has a small tank (≈500 $in^3$), having a 1,500 to 2,500 watt heater with a fill valve and a steam discharge valve as shown in FIG. 1. The system also includes a pressure relief valve and a low water liquid level cut-off switch for safety purposes. The operating parameters provide a pressure up to 200 PSI, and a temperature up to 350° F. Generally, the water tank shown in FIG. 1 has a capacity of approximately three quarts. The steam flow provided is in the range of about 0.005 to 0.007 gallons per minute (GPM). A problem with this type of system is that it can take up to thirty minutes from a cold start to reach operating temperature and pressure. Since the system is made to be portable, the water supply is intermittent at about three quarts per filling for a run time per filling of one to three hours.

This type of small, light weight and low capacity system has a number of operational limitations and one very serious safety problem. The system is limited by it's low water volume since only three quarts of water can be used at any one time, then the system must be powered down, pressure reduced to atmospheric and then refilled with fresh water. It also suffers with the problem of a long heat-up time; typically thirty minutes before any steam is generated. The steam tank, being a substantial size and having a water capacity of only three quarts, has a large, heavy, thick-walled and expensive certified steam pressure vessel.

The serious safety problem is because the super-heated steam/hot water combination can explode to a substantial volume if a tank failure occurs. Generally, the steam explosion can be on the order of 200 times the tank volume. A typical commercial unit, as shown in FIG. 1, has a 7"×13" cylindrical tank with a volume of 500 cubic inches, which could produce a steam plume of approximately 100,000 cubic inches (expansion ratio of 200) which is of sufficient size to injure anyone within 4 to 5 feet of the tank wall. A 7"×13" tank with a standard wall thickness of 0.034 inches, 304 type stainless steel has a Barlow burst pressure of approximately 2,400 pounds per square inch (PSI) and a safety factor of approximately twelve (12). Using a flat welded end.of the pressure tank can reduce the safety factor to below 3.

The end result of a study of existing small portable steam cleaners is as follows: 1) All units are heavy and bulky. 2) Have severely limited water supplies. 3) Units must be shutdown, depressurized and cooled to replace the water supply. 4) Units must use expensive heavy wall tanks to contain super-heated steam. 5) Have lengthy (≈30 minute) start-up times. 6) Require tank certification to steam boiler codes. 7) Contain from three quarts or one to 6 pounds of super-heated steam during operation. 8) Have operating energy potential to expand explosively if ruptured with concomitant injury to operating personnel and nearby persons.

Ordinary operating systems such as industrial, production facilities, office areas, food service areas, medical/dental facilities, marine facilities, all human and animal sanitary facilities are covered inside and out with contaminated surfaces. Various types of inert particles and biological species, chemical powders and fluids are deposited on these surfaces. Mankind has used various fluids, soaps, powders, rags, vacuum cleaners, etc. for centuries to clean up and possibly sanitize all manner of surfaces with varying degrees of success. Often these methods do nothing more than push the material around picking up some of it while leaving residue that still contain considerable contamination.

Therefore, it is one object of the present invention to provide an efficient steam generator that is small in size and has an extremely low (≈$2\times10^{-6}$ Gal or $2\times10^{-5}$ lbs) super-heated steam volume in the boiler at any given time during operation.

Still another object of the present invention is to provide a steam generating system that can be light in weight, yet provide unlimited:continuous supply of steam.

Yet another object of the present invention is to provide a steam generating system that has an extremely short transient heat-up time. For example, a steam generating time of three to five minutes from a cold start.

Yet another advantageous object of the invention is to provide a light weight, low capacity steam generating system that can be refilled while in use, thus providing continuous steam supply.

Yet another object of the present invention is to provide a light weight, low volume steam generator that has a design that is inherently.fail safe because it has a cylinder rupture safety factor many times larger (S.F. ≈39) than that of present systems.

Still another object of the present invention is to provide a light weight, low capacity steam generator system that has a reduction in operating super-heated steam weight by a factor of approximately 0.5 million.

Still another object of the present invention is to provide a light weight, low capacity steam generating system that has the important major inherent safety design feature of a continuous open ended flow from the water supply to the steam generator to the outside world.

Yet another object of the present invention is to provide a light-weight, low capacity steam generating system that includes a method of preventing water droplets from being ejected with the steam from the system.

Still another object of the present invention is to provide a light-weight, low capacity steam generating system that includes an extension at the outlet that minimizes ejection of water droplets into the steam.

Yet another object of the present invention is to provide a light-weight, low capacity steam generating system having an end formed on the extension that minimizes the injection of water droplets into the steam.

Still another object of the present invention is to provide a modified steam generating tank that can be easily mounted in a compact portable housing.

Yet another object of the present invention is to provide a vertically oriented, squat steam generating tank having a flat spiral heater at the bottom covered by a small volume of water.

Still another object of the present invention is to provide a light-weight, low capacity steam generating system having a method of maintaining the temperature and pressure of the super-heated steam from the steam generator outlet-to a cleaning tool.

Still another object of the present invention is to provide a light-weight, low capacity steam generating system having a special coaxial output hose configured to substantially reduce steam heat loss to the atmosphere during transportation of steam from the steam generating cylinder to an application tool or brush.

Yet another object of the present invention is to provide a light-weight, low capacity steam generating system having an insulation plastic tube over a smaller diameter Teflon tube as a thermal insulator to physically shield and protect against abrasion during use.

Still another object of the present invention is to provide a light-weight, low capacity steam generating system having a small diameter, output tube wound around a steam generating cylinder to maintain the temperature of the super-heated steam and.increase the thermal conductivity from the outlet to the application tool or brush.

Another object of the present invention is to provide a steam cleaning applicator or wand for use with the steam generating system of the invention.

Still another object of the present invention is to provide an applicator having a steam distribution arrangement for evenly distributing steam to a surface to be cleaned.

Yet another object of the present invention is to provide an auxiliary post heater in the steam distribution system of the applicator.

Another object of the present invention is to provide germicidal control for use in conjunction with the application of steam to a surface to be cleaned.

Still another object of the present invention is to provide high-intensity ultraviolet (UV) lamps in the applicator for sanitizing a surface being cleaned.

Another object of the present invention is to provide waste disposal to dispose of waste materials loosened from the surface by the steam generating and applicator system.

Yet another object of the present invention is to provide a wet/dry vacuum to collect and dispose waste material loosened by the steam generator and applicator.

In another optional embodiment of this invention, a practical application of a vertical steam generating tank in a compact housing is disclosed. In this optional embodiment the steam generating tank is constructed to fit vertically in a compact housing that facilitates the use of a portable console. The steam generating tank is made in a squat design having a flat double reverse spiral immersion heater configuration. The steam generating tank is short having a length-to-diameter ratio that is approximately 1:1. The tank is oriented vertically with the flat double reverse spiral heater at the bottom of the tank so that it can be covered by a small volume of water. An outlet to the steam applicator is provided at the top of the tank.

The water is heated to create steam that rises in the tank and exits through the outlet at the top. A large empty volume above the waterline is created so that water droplets captured in the steam will fall back to the bottom as the steam rises to the top. Baffles may be employed in the tank as described previously to facilitate the capture and removal of water droplets from the steam as it is generated.

The generated steam is delivered to an applicator that is unique in function and design. The applicator has multiple sections for applying steam to loosen debris and dirt from the surface, a second section for vacuuming away the loosened materials, and a third section for sanitizing the area that has been cleaned. The central area of the applicator is provided for applying steam. In this section a post heater is provided to maintain the constant temperature of the steam applied to its surface. Along side and parallel with the application of the steam is a section which includes suction for removing debris loosened from the surface. Adjacent and parallel to this vacuuming and steam application are germicidal lamps preferably ultraviolet (UV) for sanitizing the surface being cleaned.

BRIEF DESCRIPTION OF THE INVENTION

The purpose of the present invention is to provide a light weight, low capacity steam generating system that is very portable and safe to use. The present invention addresses and solves all eight deficiencies of current small portable production steam cleaning units listed above.

The invention described uses two different applications based upon a single approach to efficiently and rapidly transfer heat energy from a hot source to a body of water or related type fluid. The hot source is normally a resistive wire (nichrome, etc.) coil or hot gas such as a methane gas heater flame. While the disclosure is focused upon electric wire heating rods, the principles and techniques apply equally as well for gas fired heated rods and tubes.

The basic technical approach employed is to heat a small quantity of working fluid such as water, in as brief a time as possible. For example, one ounce to one pound of water in a time span of a few seconds to several minutes (one to ten minutes).

The system uses approximately a one foot long hollow cylinder having a central located heater body and a plurality of baffles spaced along the interval length of the volume. Water is injected at an input and flows through a series of time delay turbulent creating baffles positioned in the heating cylinder to form a diffused flow path of variable length and dwell time as it passes from the input to the exit. In the steam generating mode the diffused spiral flow path will cause the small amount of water injected at the input to be converted to steam as it is transported to the output port.

Preferably, the baffles are equally spaced along the cylinder and cause the fluid flow path to alternate through a series of control orifices or ports from a position adjacent to the hot outside diameter (OD) surface of the cylindrical, centrally located heater to the inside diameter (ID) surface of the cylindrical steam chamber. The ports or orifices in adjacent ring shaped baffles, are shaped and sized and are at 180° to one another to increase turbulent mixing of the water or fluid, converting it to vapor/steam combination as it passes from the input to the output. The combination of adjacent baffles, heater OD and steam chamber support ID produces a series of alternating orifice generating steam jet expansion and orifice steam jet compression subsystems that maximize the heat transfer from the cylindrical heater body to the working fluid converting the fluid to steam at the output.

The steam jet compression/expansion sequence in combination with the interbaffle volume, is a critical element of the invention in that it produces intimate turbulent scouring of the developing steam jet over the entire internal surfaces of the baffle volume segments and the external surface of the cylindrical heater maximizing dynamic heat transfer coefficients. Thus, the external surface of the cylindrical heater converts the working fluid to clean dry droplet free steam or wet steam as required at the output.

Another unique feature of the invention is the provision of a variable pressure open ended pressure regulating control valve on the steam output port. This allows the pressure and flow volume of the steam output of the heater/baffle system to be controlled while providing for an always "open" flow through system (i.e., no possibility of a closed steam valve between the input and output). It also allows further regulation of the overall vapor/steam dwell time for the formation of the steam at the output in the steam support tube. Further, the variable control valve allows control of output pressure (e.g., 10 to 200+PSI) of the steam cleaning jet as required by each cleaning situation and environment.

Another essential element of the invention is to provide an adjustable low flow rate capability (e.g., near 0 to 1.0+) gallons per minute (GPM) by means of a pulse type pressure pump (25 to 500 PSI) injecting feed water into the coaxial steam chamber input at a pressure determined by the open ended output variable pressure control valve.

Research into pumps reveal that there are no industrial fluid pump suppliers (Thomas Register of American Manufacturers and related publications) capable of providing the very low flow rates at the pressure required. Therefore, the present invention includes a newly designed pulse type pump to supply the pressure performance and flow capacity described above.

The fluid pump design consists of a forward and aft sliding piston driven by a rotating variable diameter eccentric, driven at a constant speed by a rotary motor. An input check valve, in combination with an output check valve, motor and piston produce a pulsed water flow output. The volume of water delivered to the steam generating cylinder and support tube at the input can be adjusted by adjusting the diameter of the pump piston, the stroke of the eccentric arm and the RPM of the drive motor. A typical set of various combinations of motor RPM, piston diameter and piston stroke, provide a wide range of fluid pumping rates (e.g., from near 0 to 1.0+GPM or more at pressures from near 0 to 500 PSI or more).

The operational life of the cylindrical heater (i.e., watt density) is a function of the heat input rate and heat extraction rate of the fluid being heated. The series of baffles, with alternating ports disclosed herein, is specifically designed to maximize heat transfer to the working fluid; thus, the heater's internal coil wire design is limited by the maximum continuous temperature of the internal coil resistance wire, (i.e., watt density) which can be up to dull red. Thus, the system disclosed herein provides a very long heater life due to programmed low to medium coil temperatures (i.e., watt density), steam tube diameter and length for various steam generating applications without a major redesign of the steam generating dimensions. Long heater life is also enhanced by the selection of high temperature metal support tubes preferably of copper or tubes with good to excellent high temperature corrosion resistance (e.g., Incoloy 316SS, 304SS, etc.).

The steam pressure cylinder surrounding the heater can vary from copper to aluminum, to stainless steel, etc. The system described can provide a Barlow steam tube bursting pressure of up to 5,833 PSI or more and a safety factor of up to nineteen (19) or more, which is substantially above current U.S. portable steam cleaning equipment.

In an optional embodiment of the invention, the plurality of baffles are replaced by single baffles at each end of the cylinder with water flowing through counter-revolution coils surrounding the centrally located heater. Water flows in through the first baffle along the length of the cylinder into the tubular coil at the opposite end. The water is then heated to steam by flowing back to the opposite end of the cylinder through two coils and then back through an outlet port. The double convoluted coils are arranged for the water to be converted to steam by three passes over the heating element. The first pass is through the cylinder while the second and third passes are through the wound copper coils from an inlet to an outlet.

The practical application of the steam generating system disclosed herein employs live steam impacting surfaces at 220° Fahrenheit to 230° Fahrenheit or more to loosen and dissolve surface contaminations which are then physically removed from the original surface and suspended (trapped) in a reduced volume of hot air and steam and a matrix of brush fibers via surface scrubbing and collection via mutual particle attraction. This concentrated conglomerate of dirt, mud, bacterial, etc. is then subjected to a vacuum and transported through a chamber from which moisture, steam, contaminants, etc. are separated from the air/steam flow and precipitated in a chamber for collection and disposal.

This process of steam heating, concentration and collection of contaminants is done in a continuous manner to arrive at a so-called "clean target surface". The target surface may be physically clean however the surface is not sanitary. In fact, a multitude of bacterial, mold spores, and viral contaminants populate the so-called "clean target surface". This invention automatically applies a fourth level of surface cleaning (i.e., sanitation) via an intense mercury vapor radiation bombardment of the target surfaces.

It has been discovered that the primary wavelength for maximum germicidal sanitation is a radiation wavelength at 254 nm (nanometers). Other wavelengths can be employed for specific effects as required. Multiple intense mercury vapor beams are applied to insure maximum destruction of all contaminants sensitive to the radiation wavelength chosen.

The operational surface cleaning process consist of four independent processes—1. hot steam impact; 2. physical brush scrubbing of a target surface; 3. vacuum removal of contaminated debris; and 4. intense radiation of clean surface to destroy remaining chemical and biological contaminants in a continuous coordinated attack.

Steam as well as brush cleaning plus vacuum removal are important steps to insure a thin (i.e., less than 0.005 thick) contaminated film is presented to the mercury vapor radiation for sanitation. If the film is too thick, the radiation may not completely penetrate the contaminated film to the surface of the target body which will leave a thin active biological layer which will in turn allow bacterium film to re-form.

The above and other objects, advantages and novel features of the invention will be more fully understood from the following detailed description and the accompanying drawings where like reference numbers identify like parts throughout, in which:

DETAILED DESCRIPTION OF THE INVENTION

Figure 2:
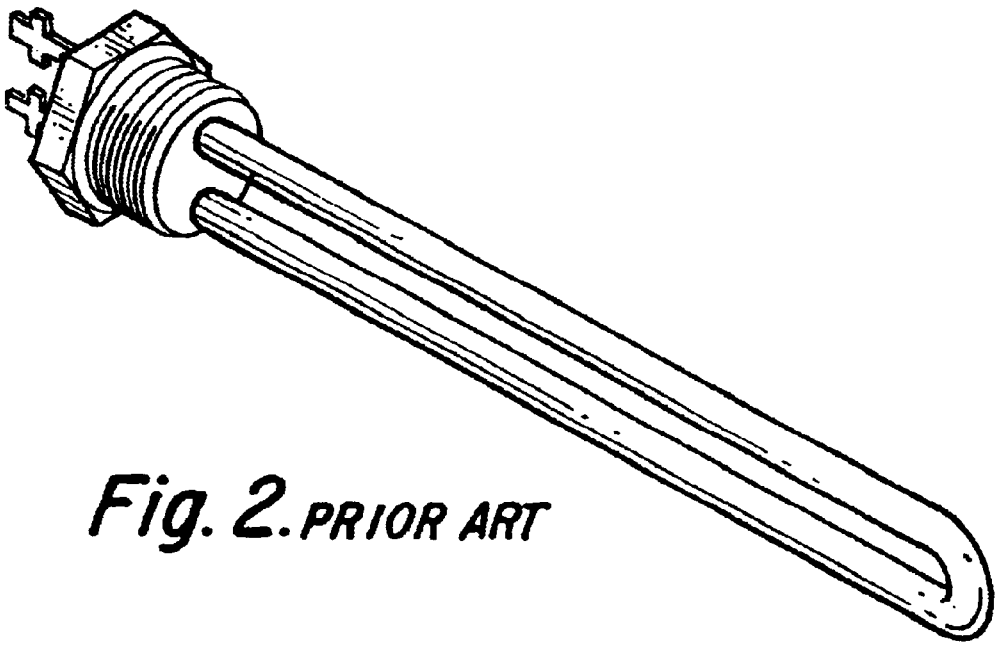
Fig. 2. PRIOR ART
FIG. 2 is an isometric view of a looped heater (e.g., a CALROD heater) well known in the art.
Figure 3:
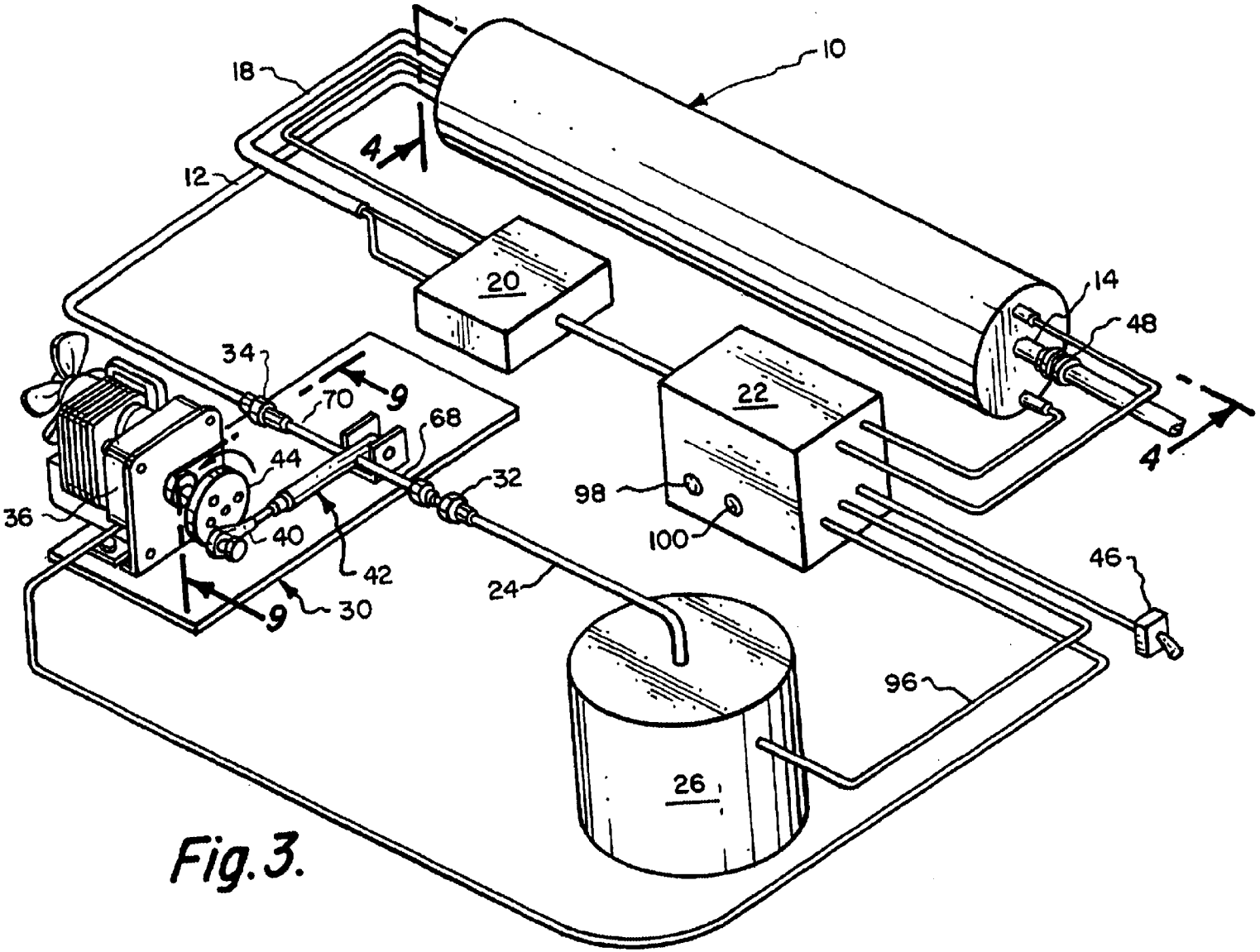
FIG. 3 is a diagram of a steam generating system according to the invention.

A steam generating system constructed according to the invention, is generally illustrated in FIG. 3. The system shown in FIG. 3 will provide an approach to efficiently and rapidly transfer heat energy from a heater body to a small volume of fluid or water and has a useful, unique application as a small volume steam generator. The heating body is normally a modified form of a resistive wire (nichrome) coil known in the art and illustrated in FIG. 2.

Generally, the heater described in this patent application will be focused upon electric heating rods, however, the principle and technique apply equally well to gas fired rods, tubes and the like.

The steam generating system of FIG. 3 is comprised of a steam generating cylinder or tube 10, having an inlet port 12 for fluid and an outlet port 14. A centrally locating heating body 15 (FIG. 4) receives power input at 18 from a heater control 20 controlled by electronic control system 22. Fluid is supplied to inlet 12 from supply tube 24, connected to reservoir 26 or other source of fluid. Fluid is pumped via tube 24 from tank 26 by a low volume pulse pump 30 through check valves 32 and 34.

Figure 9:
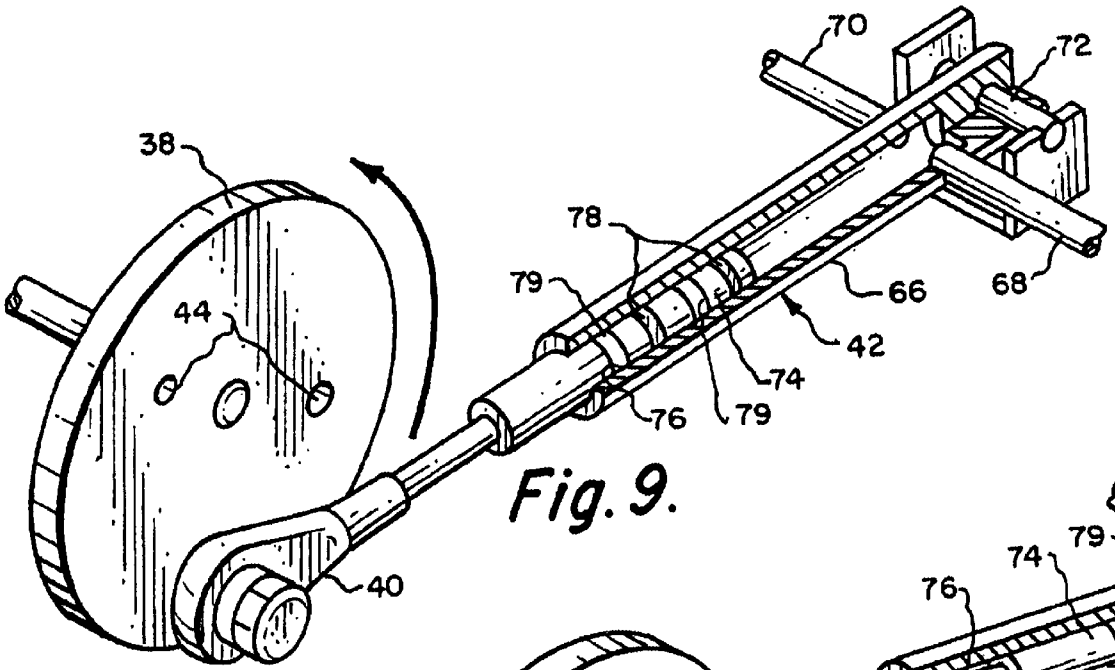
FIGS. 9 and 10 are cut-away views of a piston and cylinder of a specially designed pump for use in the steam generating system of FIG. 3 according to the invention.
Figure 10:
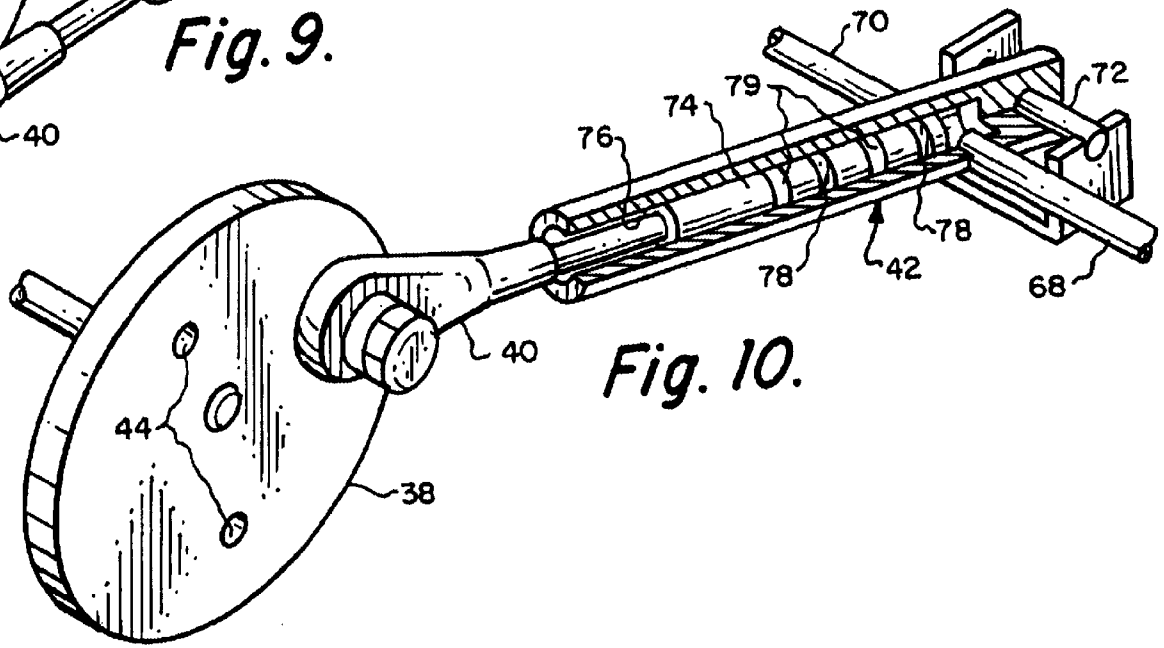

Pump 30 is specially designed for the system since extensive research revealed that there are no pumps that provide the low volume and pressure range needed for the system. The new pulse type pump 30 provides the flow performance of 0.001 to 1.0 gallons per minute, at a 50 to 200 PSI range. Pump 30 is comprised of constant speed motor gear system 36, variable diameter eccentric arm 38 (FIGS. 9 and 10) connected to drive shaft 40 of piston pump 42, which will be described in greater detail hereinafter. Piston shaft 40 is connected to one of three holes 44 in eccentric arm 38 to vary the output volume from piston pump 42. Water supply 26 is preferably through a flexible tube to a copper line, then through check valve 32 for output by piston pump 42 through check valve 34 to inlet 12. Power is supplied to drive motor 36 of piston pump 30 from on/off switch 46 through electronic control system 22.

Electronic control system 22 monitors the temperature and pressure in steam generating cylinder 10, and also the level of water in the water tank 26. Pulse type piston pump 30 provides low flow capacity and pressure required to inject feed water into the input 12 against the steam generating cylinder 10 internal pressure as regulated by output variable pressure regulating control valve 48.

The basic technical approach employed in the invention is to heat a small quantity of working fluid such as water in a brief time. For example, the system is designed to heat approximately one ounce to one pound of water in a time span of a few seconds to several minutes. The system is also designed to precisely output the same weight of fluid per unit time, as is input per unit time, so that the residual weight of fluid in heat chamber 10 remains constant over time at a predetermined value.

Figure 4:
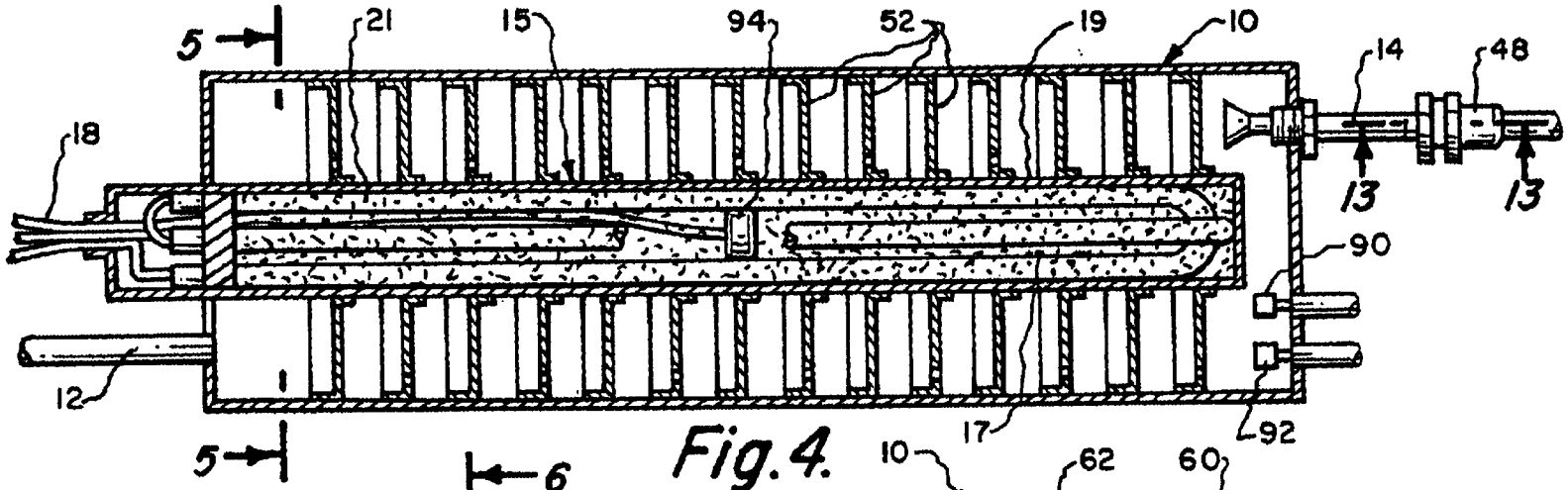
FIG. 4 is a sectional view of a steam generator used in the steam generating system taken at 4—4 of FIG. 3.
Figure 6:
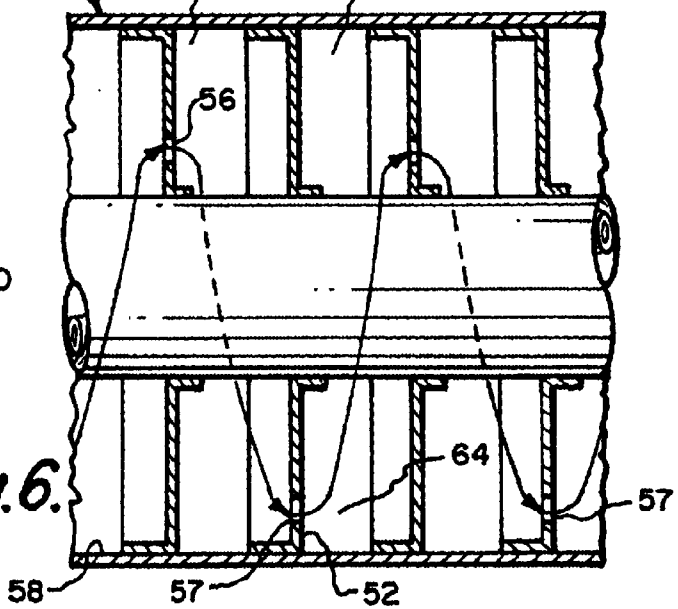
FIG. 6 is an enlarged view of the steam generator system illustrated in FIG. 4.
Figure 5:
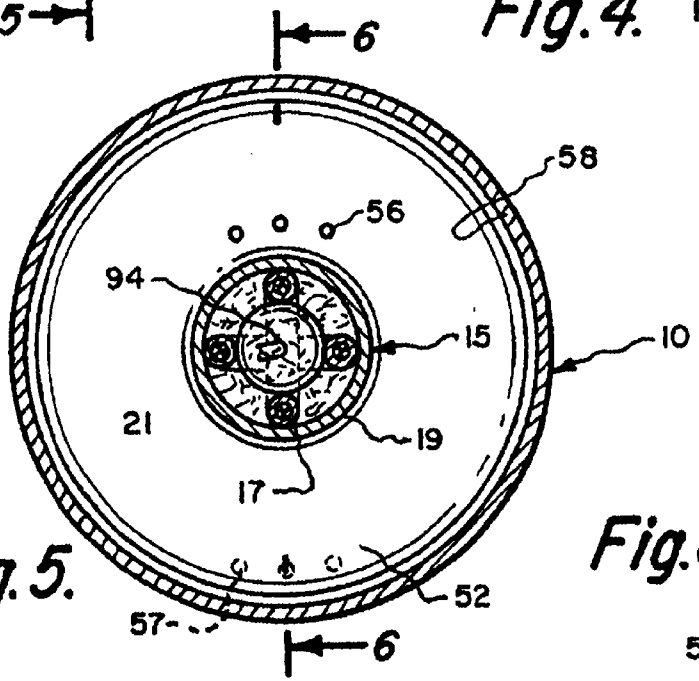
FIG. 5 is a sectional view taken of the steam generator taken at 5—5 of FIG. 4.

The operation of the steam generating system, for generating steam, is illustrated in greater detail in the sectional view of FIGS. 4 through 6. Water injected at inlet 12 is exhausted at outlet port or line 14 as steam, depending upon the configuration inside steam generating cylinder 10. A series of turbulent producing time delay baffles 52, inside cylinder 10, are positioned along heater body 15 to form a diffused flow path of variable length and dwell time of the fluid/steam combination as it passes from inlet 12 to outlet 14, as indicated by the arrows.

As shown in the enlarged baffle view of FIG. 6, the fluid/steam combination passes through a series of control orifices 56, 57 from a position adjacent to hot outside surface diameter of cylindrical heater 15 to inside diameter surface 58 of chamber 60 in steam generating cylinder 10. Ports or orifices 56, 57 offset 180° from each other, in adjacent baffle rings 52, orifices 56, 57 are shaped and sized to increase turbulent mixing of the fluid/vapor/steam combination as it passes from inlet 12 to outlet 14. In particular, the combination of two adjacent baffles, the OD of cylindrical heater 15 and steam chamber 60 form a series of steam expansion followed by steam compression/injection subsystems that maximize heat transfer from cylindrical heater body 15 to the fluid in steam generating cylinder 10. Thus, chambers 62 and 64, between adjacent baffles 52, form a compression followed by expansion subsystem maximizing heat transfer from hot cylindrical heater 15. Preferably, steam generating baffles 52 are equally spaced at intervals that are about one inch or approximately twelve per foot.

For example, first orifices or ports 56 (on the left) form an inward steam compression/high speed jet injected into low speed turbulent expansion chamber 62. The next ports 57 offset at approximately 180° from ports 56 provide an output steam compression/high speed jet into the second low speed turbulent expansion chamber 64 and so on through the length of chamber 10. The arrows indicate the steam flow pattern around the circumference of hot cylindrical heater 15. Steam compression/high speed jet forming ports or orifices 56, 57 preferably alternate from inside to outside and back to inside through the respective series of baffle rings 52 to alternately compress and expand the steam fluid.

The steam jet compression/expansion sequencing through respective ports or orifices 56, 57, in combination with the interbaffle volume, is a critical element of the system in that it produces turbulent scouring of the developing steam jet over the entire internal surfaces of the baffle volume segments. This also provides turbulent scouring over the entire external surface of cylindrical heater 15; thus, providing clean, dry, droplet free steam or wet steam as required at output 14. Preferably, in the system shown, the steam generating cylinder 10 is about one foot long, with baffles spaced approximately one inch apart.

Figure 7:
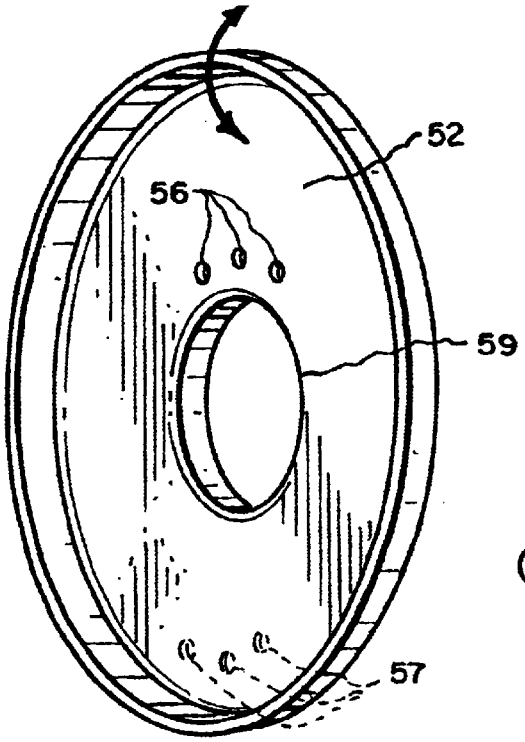
FIG. 7 is a diagram showing the construction of the baffles used in the steam generator system of FIG. 4.
Figure 8:
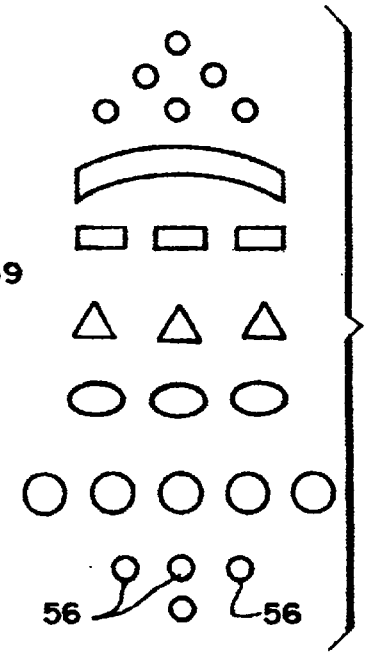
FIG. 8 shows eight possible variations of hole patterns for ports or orifices in baffles used in the steam generator of FIG. 4.

A typical baffle is shown in FIG. 7. Variations in the design of the ports or orifices 56, 57 are shown in the diagram of FIG. 8. Parts or orifices 56, in one baffle 52, would be near the center while ports or orifices 57 shown in phantom, would be near the periphery in an adjacent baffle 52. Optionally, all the orifices could be in the same position in each baffle 52, but offset 180° by rotating the baffle at installation. Each baffle 52 is in the shape of a round shallow pan having a flexible rim 55 that allows the baffles to be positioned in :cylinder 10. Flexible rim 58 fits tightly against the interior surface of cylinder 10 to maintain a good seal. Hole 59, in the center of each baffle 52, allows heater 15 to pass through each baffle and be centered in cylinder 10.

Ports or orifices 56, 57 can all be the same shape and of the same number in each baffle, but a variety of shapes, sizes and numbers can be used as illustrated in FIG. 8. The size and arrangement of each aperture could be selected according to the application to create faster, slower or more turbulent flow. Preferably, the total area of all the ports in any configuration for generating steam would be less than approximately 0.50 square inches. Starting from the top of FIG. 8 and working downward, ports or orifices 56, 57 could be: All circular in a triangular pattern; one elongate curved slot; three rectangular slots; three triangular holes; three oval holes; five circular holes; three circular holes; or one large circular hole with the size of any hole being varied as needed. The preferred embodiment shows baffles 52 with three circular holes for illustration purposes, but could be any of the various patterns or shapes illustrated in FIG. 8. The variations possible are nearly infinite.

Another unique feature of the invention is the use of a variable pressure control valve 48 (FIG. 4) at the output 14 of steam generating cylinder 10. Variable pressure control valve 48 allows both the pressure and flow volume of the steam output of the heater/baffle system to be controlled. Variable pressure control valve 48 also allows further regulation of the overall fluid/vapor dwell time for the formation of steam within steam generating cylinder 10. Variable pressure control valve 48 also allows direct control of the output pressure (e.g, 10 to 200+ PSI) which, in turn, regulates the temperature of the steam from the cleaning jet as required by each cleaning situation and environment.

A major safety feature of variable pressure control valve 48 is the open end design in which the orifice size is flexible to allow a large orifice to accommodate greater flow rate which in turn, limits the maximum internal pressure of chamber 10. A fixed orifice could become clogged, which would allow pressure in chamber 10 to reach unsafe high levels.

Another essential element briefly described previously, is the flow capacity (0.001 to 1.0 GPM) high pressure pump (50 to 200 PSI) required to inject feed water into the steam tube at input 12 against the internal pressure of steam generating cylinder 10 controlled by the output variable pressure control valve 48. Since no such pump, having the particular pressure/flow operating range desired could be found, a pump was designed to produce the variable low flow capacity and variable pressures desired. A detailed view of the pump piston 42 is illustrated in the cut-away views of FIGS. 9 and 10.

Pump piston cylinder 42 is comprised of pump cylinder 66 having inlet 68 and outlet 70, connected respectively to check valves 32 and 34 (FIG. 3). Cylinder 66 is pivotally mounted on cross shaft 72 to pivot as eccentric arm 38 rotates. Pump piston 74 fits inside chamber 76 in cylinder 66, and is sealed by a pair of double-seal O-rings 78. Non-precision grooves 79 are filled with oil to lubricate piston 74. Pump piston 74 is driven in a variable linear stroke by pump motor 30 and eccentric arm 38 that has three or more different positions to vary the stroke of piston 74.

Input check valve 32 and output check valve 34, motor 36 and piston provide a pulsed water flow output. The volume of water delivered to steam generating cylinder 10 at input 12 (FIG. 3) can be adjusted by varying the diameter of pump piston 74, the diameter of eccentric arm 38 and the RPM of drive motor 36. A typical set of parameters is as follows:

| MOTOR RPM | PISTON DIAMETER (IN) | PISTON STROKE (IN) | AVERAGE PUMPING RATE (GPM) | TIME TO DELIVER 3 GAL |
|---|---|---|---|---|
| 50 | .0297 | 0.65 | 0.02 | 2.5 HR |
| 50 | .0297 | 0.50 | 0.013 | 3.8 HR |
| 50 | .0297 | 0.40 | 0.009 | 5.6 HR |

Various combinations of motor RPM, piston diameter and piston stoke provide a wide range of fluid pumping rates. With variations shown, the pumping rate can be varied from close to 0 to 1.0 gallons per minute (GPM) or more at pressures from near 0 to 200 PSI or more.

The operational life of cylindrical heater 15 (FIGS. 4 through 6) is a function of the heat input rate and heat extraction rate of the fluid being heated. The series of baffles 52, previously described, are specifically designed to maximize heat transfer to the working fluid; thus, the internal heater wire design of heater 15 is limited by the maximum continuous temperature of the internal coil resistant wire which can be up to dull red. The generally accepted operational heater maximum heat generating capacity is defined as watt density, which is the nominal electrical input wattage divided by the surface area of heater 15. The surface area is the product of the circumference of the cylinder times the length of the cylinder. Thus, watt density is as follows:

$$WD=W_n/\pi DL$$

where:

$W_n$=number of watts

D diameter of the cylinder

L length of the cylinder $\pi$=3.1415

For a long heater life WD is normally less than 75 watts/in$^2$. In the invention disclosed herein, where the diameter of cylindrical heater 15 is approximately 1.5 inches and has an internal effective heater length of approximately 11.5 inches and maximum wattage of 1800W, the result is a watt density of approximately 33.2 watts per square inch, which provides a very long heater life plus the ability to vary the heater wattage without a major redesign of the dimensions of the steam generating system.

Long system life is also provided by selecting high temperature metal tubes with good to excellent corrosion resistance (e.g., Incoloy, 316SS, 304SS, etc.). The steam generating cylinder or steam pressure vessel 10, surrounding heater 15 can vary from copper to aluminum to stainless steel, etc. In this particular application, consideration of a fluid steam environment up to 150 PSI at 300° F., 304SS (stainless steel) three inch pipe with a wall thickness of 0.035 inches provides a Barlow bursting pressure of:

$$P=2St/D$$

where:

material: ½ hard 304SS;

P=internal pressure PSI;

S=fiber strength of tube material is 250,000 PSI,;

t=wall thickness in inches (0.035);

D=outside diameter of steam generating cylinder 10 is: 3.01"

For the values described above, the bursting pressure would be 5,833 PSI. At a maximum internal pressure of 150 PSI, the bursting safety factor, which is the Barlow burst pressure divided by the maximum internal pressure at 300° F. would be in the range of thirty-nine (SF=39). This is substantially more than existing low capacity steam cleaning systems referred to previously. Additionally, the open ended variable pressure control valve 48 discussed previously substantially eliminates the possibility of a runaway high pressure burst of steam pressure vessel 10.

Figure 11:
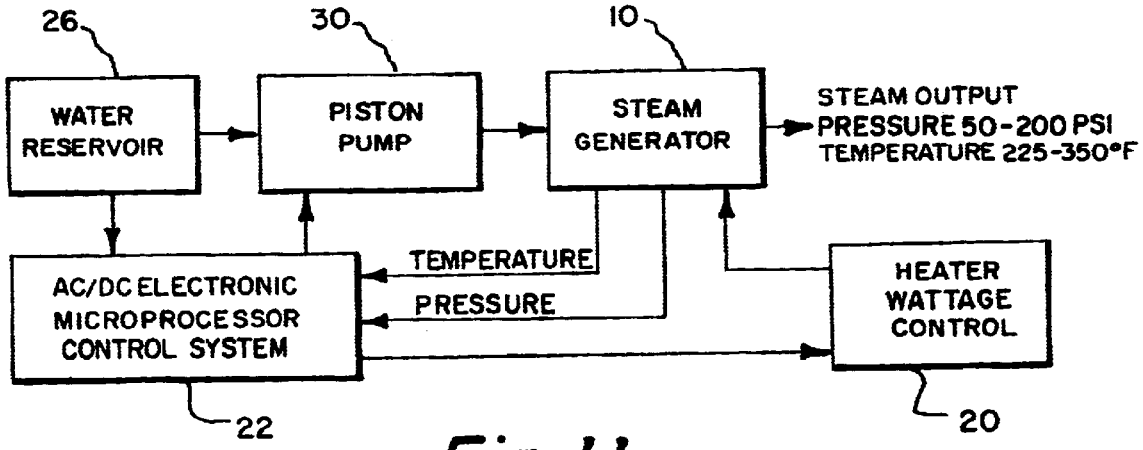
FIG. 11 is a simplified block diagram of the steam generator system according to the invention.
Figure 12:
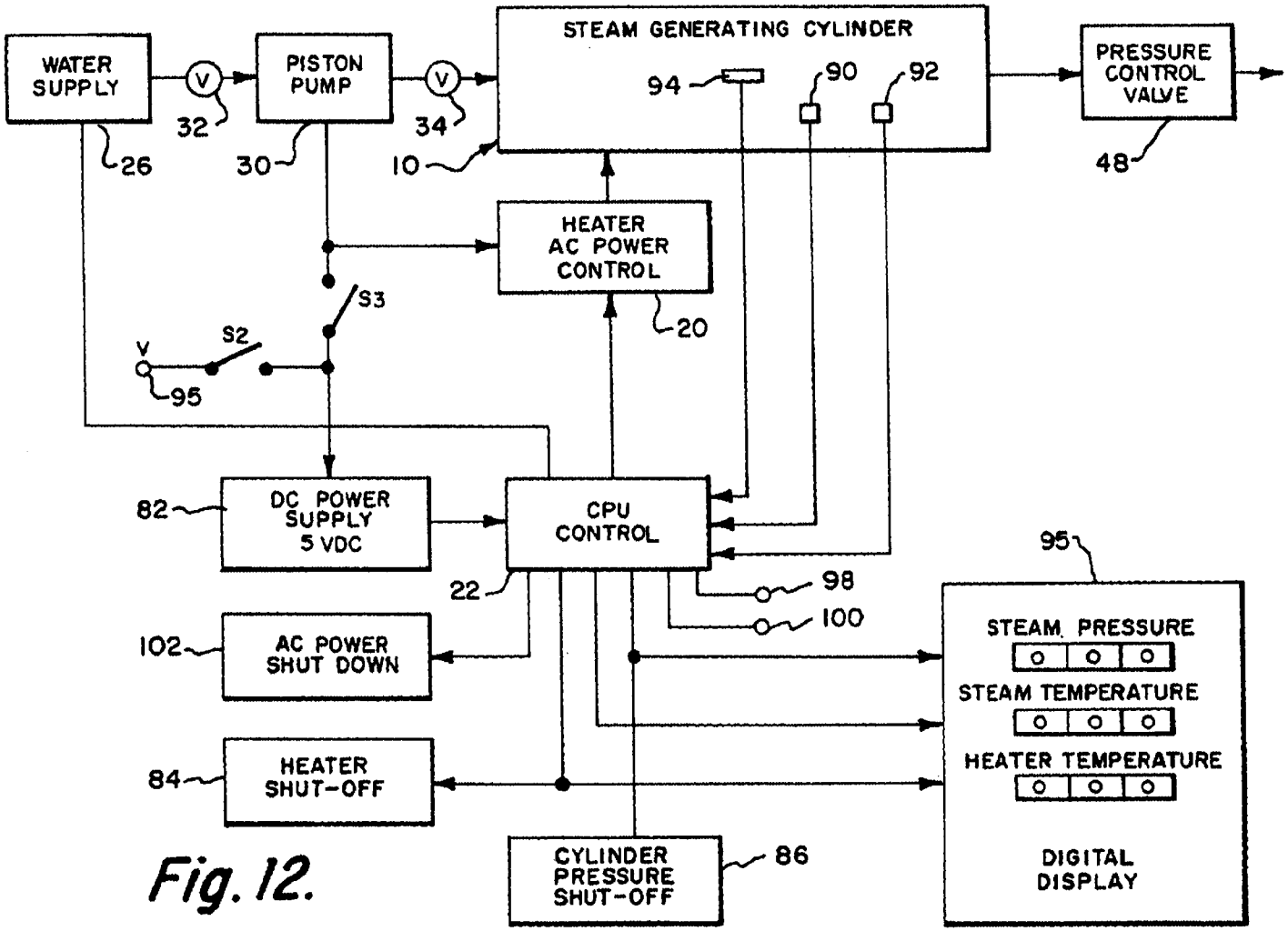
FIG. 12 is a more detailed electrical/electronic schematic diagram of a steam generating system according to the invention.

A simplified block diagram of the operational parameters and the system control module include AC & DC electrical power lines, temperature and pressure transducers and a microprocessor for controlling these parameters is illustrated in FIGS. 3, 11 and 12. Microprocessor (CPU) 22 receives input from water reservoir 26, and steam generator 10, and provides an adjustable heater wattage control 20.

A more detailed mechanical and electrical schematic layout of the steam generating system is illustrated in FIG. 12. The system of FIG. 12 has a water supply 26 supplying water to check valve 32 to piston pump 30, which then flows through check valve 34 into steam generating cylinder 10 having an internal heater as described with respect to FIGS. 4 through 6.

AC Power Switches S2 and S3 turn on the power to the overall system and to piston pump 30. Power is supplied to microprocessor controller 22 from 5 volt DC power supply 82 receiving input from 120 volt power input switch S2. Power input at terminal 95 can be 120V AC, 240 AC or even a DC voltage. Shutdown switches 84 and 86 shut down the system if temperature or pressure values exceed specified limits. The microprocessor control system 22 monitors steam temperature through transducer 90, steam pressure through transducer 92 and internal heater coil temperature through transducer 94 (FIGS. 4, 5 and 12). The steam pressure, steam temperature and heater coil temperature are displayed by digital display 95 by outputs received from microprocessor control system 22.

The microprocessor control also receives a water level input on line 96 from water supply 26. Red light 98 indicates a low water condition while green light 100 indicates the water level is acceptable. An AC power shutdown switch 102, associated with the water level transducer, will turn off heater 15 if red light 98 comes on.

Heater 15 internal temperature is controlled with a range of 60° F. to 1500° F. via thermocouple 94. The steam temperature is controlled between a temperature of 212° F. to 350° F. via thermocouple 90 while the steam pressure is kept within arrange of 50 to 150 PSI, via pressure control valve 48. Should the parameters monitored by microprocessor 22 exceed any one of these limits, the system will be shutdown to prevent any dangerous runaway condition.

Figure 13:
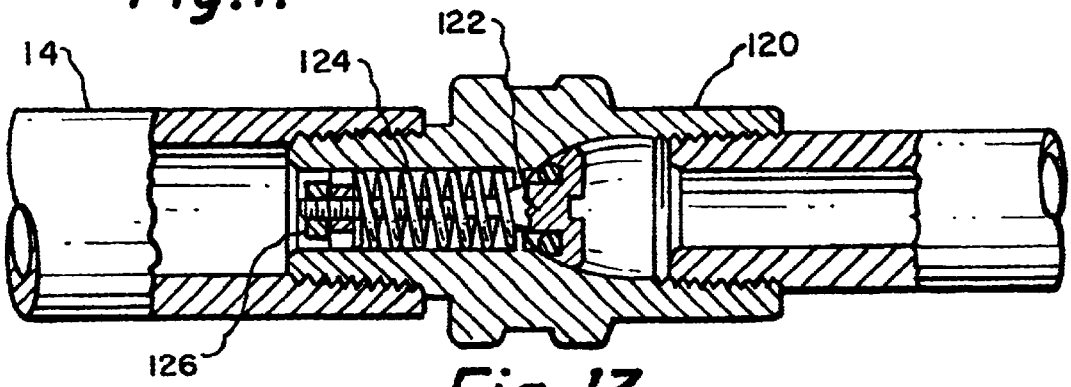
FIGS. 13 and 14 are sectional views of a variable pressure control valve taken at 13—13 of FIG. 4.
Figure 14:
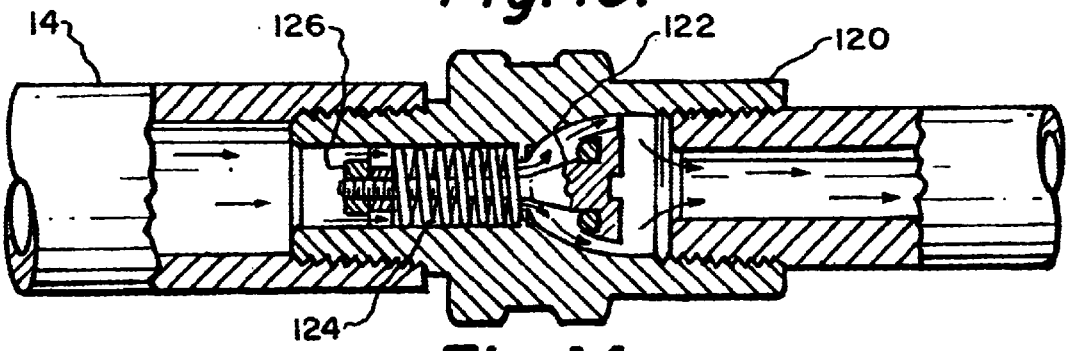

Another inherent safety feature is the use of an open ended variable pressure control valve 48 in output line 14 shown closed and open respectively in FIGS. 13 and 14 which automatically maintains the maximum chamber 10 pressure at 150 PSI or as required. Pressure control valve 48 may be a Model No. VRVI-250B-B-/50 manufactured by Generant of Butler, N.J. or equivalent. Pressure control valve 48 has a body 120 with a flow through port 122 open and closed by variable spring 124 adjustable by spring force adjustable nut 126.

Figure 15:
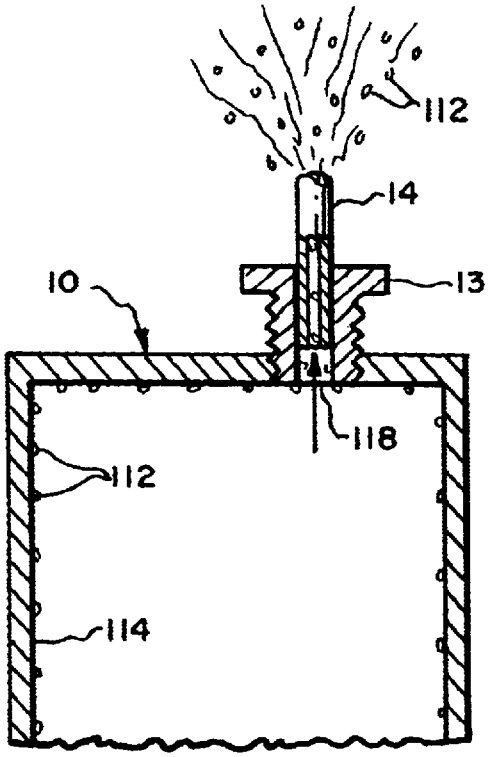
FIG. 15 is a partial sectional view of the steam generating cylinder and outlet port illustrating the problem of water droplets being ejected with the super-heated steam by surface tension or capillary action.

A problem with the steam generating cylinder 10 of FIG. 4 that may occur is illustrated in FIG. 15. Steam generating cylinder 10 generates super-heated steam that exits through outlet port 14 connected to the steam generating cylinder through bushing 13. The method of porting super-heated steam from outlet 14 to the pressure control valve is of importance to minimize ejecting water droplets 112 into outlet port 14. Super-heated water droplets 112 attach to interior surface 114 of steam generating cylinder 10 pass through outlet bushing 13 and outlet line or port 14. Super-heated water droplets 112 are carried into outlet 14 by surface tension as steam is formed and ejected through port 14. Water droplets 112 in super-heated steam.can reduce the effectiveness of the steam by including water droplets which produce wet steam.

Figure 16:
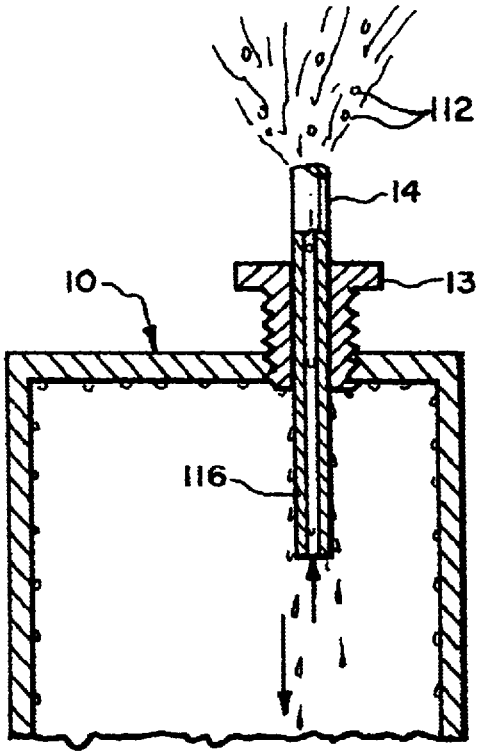
FIG. 16 is a partial sectional view of the steam generating cylinder and output port having a tube extension to minimize injection of water droplets into the super-heated steam.
Figure 17:
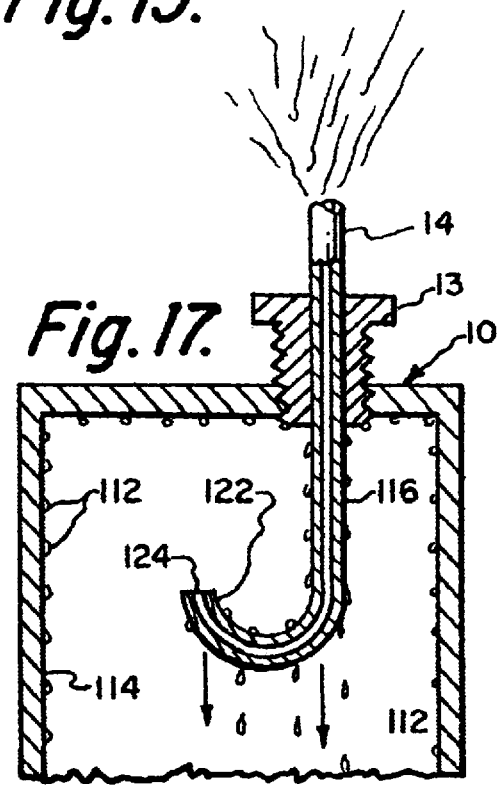
FIG. 17 illustrates a modification of the embodiment of FIG. 16 to further minimize injection of water droplets at the outlet port.
Figure 18:
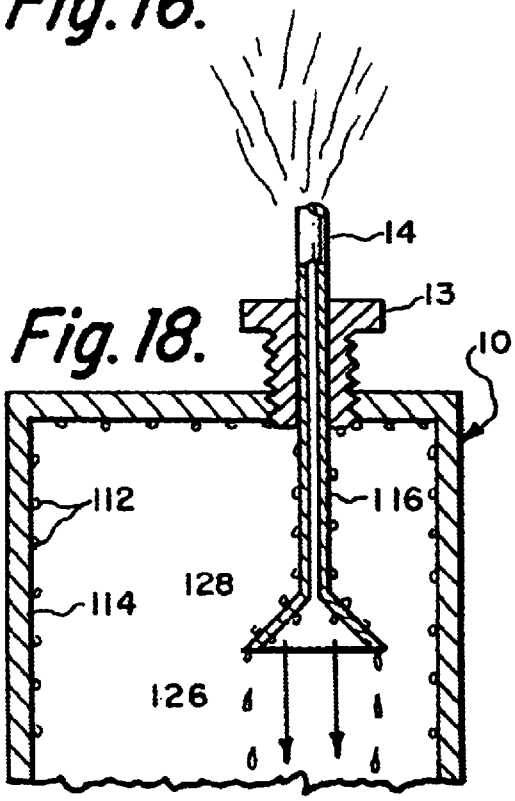
FIG. 18 is another partial sectional view of the steam-generating cylinder and outlet port illustrating a modification of the tube extension to minimize injection of water droplets into the super-heated steam.

This unwanted side effect can be corrected or controlled by the methods shown in FIGS. 16 through 18. To minimize this affect, outlet tube 14 is provided with an extension 116 ahead of inlet 118 into bushing 13. With steam generating cylinder oriented into a vertical position extension 116 minimizes the affect of surface tension that permits water droplets 112 to creep into outlet port 14.

Additional improvements to control the ejection of water droplets from 112 that collect on interior wall of 14 of steam generating cylinder 10 are shown in FIGS. 17 and 18. In FIG. 17 vertically oriented steam generating tank 10 has an extension 120 with an end 122 that bends 180° so that the inlet 124 is oriented upward. Thus super-heated droplet 112 will fall back into steam generating cylinder 10 controlling the number of droplets in the super-heated steam exiting through outlet tube or port 14.

Another method of controlling super-heated droplets in the steam is illustrated in FIG. 18. If this embodiment and extension 116 is provided with a conical end 128 that directs the super-heated droplets 112 away from inlet 126. Super-heated droplets 112 fall off cone 128 back into steam generating cylinder 10. Extensions 116 on outlet tube or port 14 can be applied to any steam generating cylinder 10 whether it is oriented vertically or horizontally. Extensions 116 will be properly positioned to maximize the gravitational force to prevent super-heated droplets 112 from exiting with the steam from outlet port or tube 14.

Figures 19, 20:
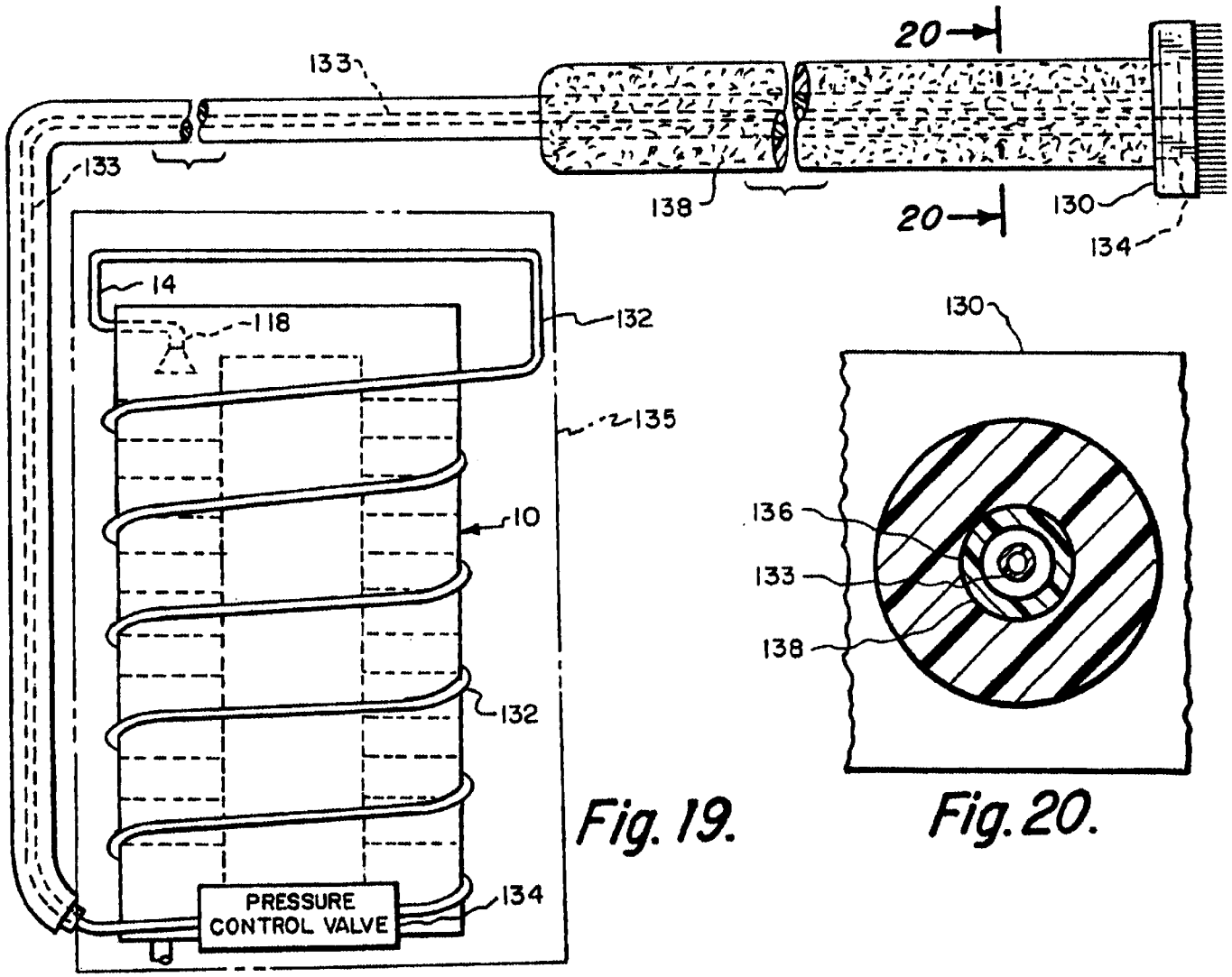
FIG. 19 is a semi-schematic diagram of a post-heating super-heated steam system illustrating the application of copper or similar heat conducting metal tubing thermally attached to the external surface of the steam generating cylinder.
FIG. 20 is a sectional view taken at 20—20 of FIG. 19.

It is also important to reduce or control steam heat loss to atmosphere during transportation of steam from steam generating cylinder 10 to application tool or brush 130 (FIG. 19). To maintain the temperature of super-heated steam, a post-heating system is provided as shown in FIG. 19. The post-heating system is comprised of copper tubing 132 wrapped around the outside surface of cylinder 10 from pressure control valve 134. The post-heating system of wrapped copper tubing 132 also helps to eliminate water droplets from the output steam to applicator 130 by substantially increasing the thermal conductivity between stainless steam generating cylinder 10 and wrapped copper tube 132. Copper tubing 132 absorbs heat energy from steam generator 10 external surface which then superheats steam coming from exit port of variable pressure control valve 134 which reduces the steam temperature by adiabatic expansion as it exits the pressure control valve. The post-heating system further reduces the accumulation of any water droplets in the output tube. The entire system of steam generating cylinder 10 pressure control valve 134 and copper tubing 132 would be encased in a conventional fiberglass insulating jacket 135 illustrated in phantom.

To reduce heat loss from the super-heated steam variable pressure control valve 134 should be located as close as possible to applicator 130. It can be located in the wand or handle of applicator 180 beneath insulation 138 or could be inside the applicator as indicated in phantom at 134'.

Plastic tube thermal insulation 136 (FIG. 20) also serves to maintain the temperature of the steam and reduce water droplet formation. Heavy wall thermal insulator 136 which may be braid vinyl tubing reduces thermal conductivity between small inner Teflon tube 133 connected to the end of copper tubing 132 and larger heavy wall tube 136 delivering super-heated steam to cleaning tool or brush 130. An additional soft foam-type outer insulation 138 is provided for abrasive protection for the inner insulation 136 and smaller diameter Teflon tube 133 and also provides an ergonomic handle to protect the user's hands from hot Teflon 133 during use.

Sectional view of FIG. 20 illustrates the insulation of the post-heating system at the application tube or brush 130. Teflon tubing 133, preferably about ⅛ inch diameter, "floats" inside of and is protected by an outer plastic insulating tube 136 from where it is connected between copper tube 132 and applicator brush 130. A loose fit between insulation 136 and Teflon tube 133 provides an insulating air space that reduces thermal conductivity between heavy walled insulating tube 136 and much smaller Teflon tube 133 delivering higher temperature steam to cleaning applicator brush 130. An additional heavy insulation 138, which may be a soft foam insulation suitable for ergonomic use, provides physical and thermal protection for the operator.

In operation super-heated steam exits through cone 118 to outlet 14 for delivery to pressure control valve 134. Super-heated steam enters copper tubing 132 wound around steam generating cylinder 10 to provide high thermal conductivity maintaining the temperature of the steam and minimizing the formation of water droplets. Copper tubing 132 then connects to Teflon tubing 133 covered by insulation 136 after it leaves steam generating cylinder 10 for delivery of super-heated steam to applicator brush 130. Heavy insulating cover 138 on a portion near applicator tool or brush acts as an ergonomic handle providing physical and thermal protection for the operator.

Figures 21, 22:
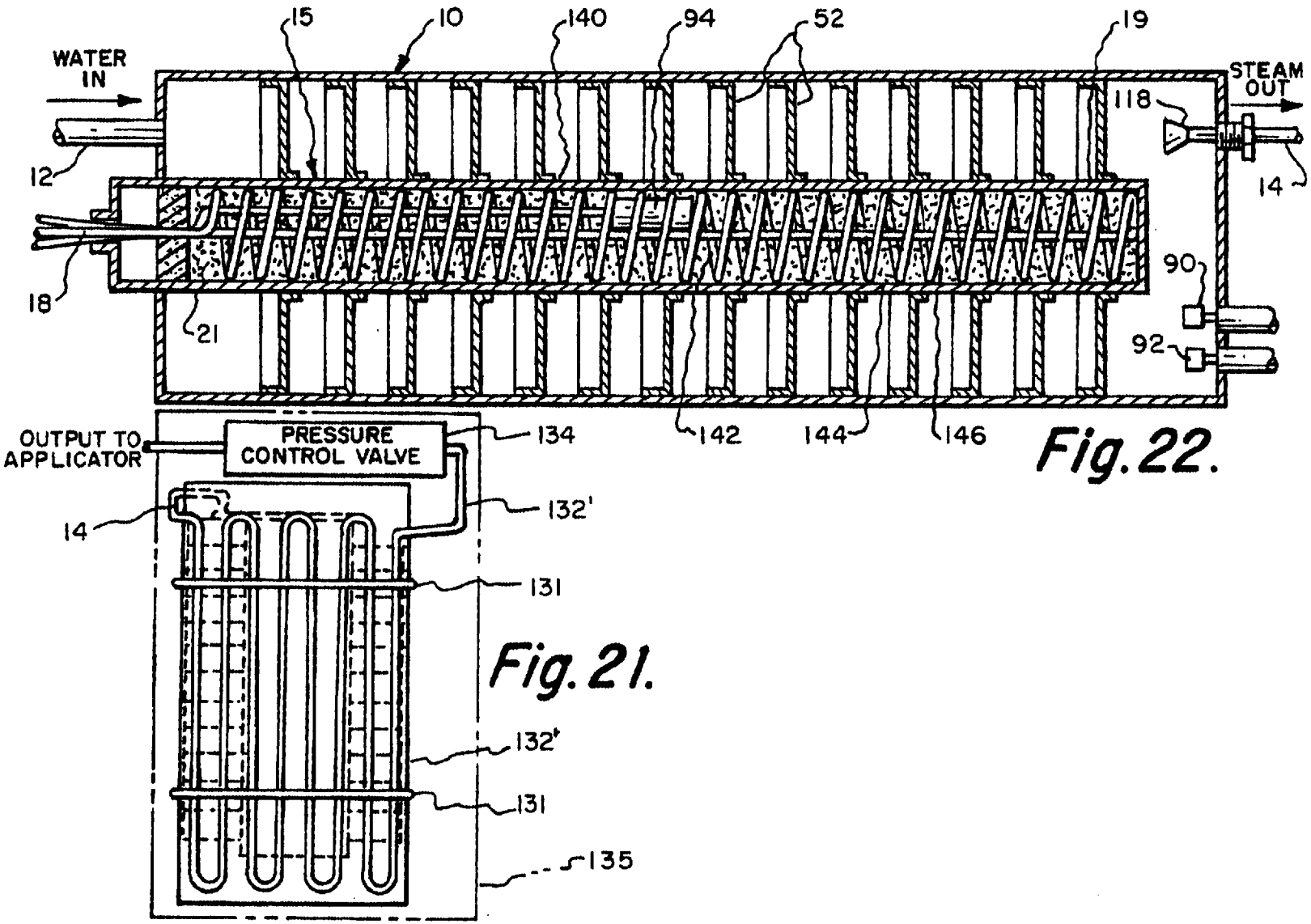
FIG. 21 illustrates an alternate, but preferred, configuration of the post-heating system of FIG. 19.
FIG. 22 is a sectional view similar to FIG. 4 illustrating a modification of the heater and incorporation of the outlet tube to minimizing ejecting water droplets into super-heated steam.

An alternate preferred configuration of the post-heating system shown in FIG. 19 is illustrated in FIG. 21. In this embodiment copper tubing 132 is in a convoluted serpentine path substantially parallel to the axis of the cylinder 10 having an output to an applicator as in FIG. 19 instead of being wound around steel cylinder 10. In this configuration a more efficient, intimate contact between copper tubing 132 and steam generating cylinder 10 can be achieved. Copper tubing 132 is first arranged in a serpentine convoluted configuration on a flat surface. It is then wrapped around steam cylinder 10 and secured in place by straps or bands 131 which hold the serpentine configuration of copper tubing 132 in intimate contact around the cylindrical steam vessel 10. Post heater tube 132 is described as copper. However other metal tubing such as stainless steel may be used to resist chemically corrosive steam.

An improvement to the system illustrated in FIG. 4 is shown in FIG. 22. In this system an improved heater is provided. The steam generating system of FIG. 22 is comprised of steam generating cylinder 10 having inlet 12 and outlet 14. Centrally located heating body 15 receives power at input 18 from a power supply as previously described. Water injected at inlet 12 passes through a series of turbulent producing time-delay path lengthening baffles 52 inside cylinder 10 positioned along heater body 15 to form a defused flow path of variable length and dwell time as the water passes from inlet 12 to outlet port 14 as steam. Cone 118 on outlet port 14 minimizes water droplets condensed on the interior surface of steam cylinder 10 from exiting through outlet port 14.

The embodiment of FIG. 22 also includes a variation in heater design. In this embodiment heater 140 is designed to have a straight heating rod 142 extending along the axis of heater tube 144 and a wound shaped heating rod 146 connected to the end of straight heating rod 142. The convoluted configuration of heater 140 increases the path and provide greater heat transfer to heater tube 144. Heater tube 144 is packed with an insulating material 21 as before. Thermocouple 94 prevents heater 140 from overheating providing a feedback to the control system as described previously. Pressure and temperature sensors 90 and 92 provide feedback to the system for steam pressure and steam temperature control.

Schematic layouts of both the bare loop heater and covered/baffle heater are illustrated in FIGS. 4 through 6. A single "hairpin" loop heater, known in prior art as a "CAL-ROD" heater, is shown in FIG. 2. A variation of this heater is shown in FIGS. 4 through 6. Heater 15 is comprised of two "hairpin" looped heaters 17, normal to each other (i.e., at 180° F.) connected in series and surrounded by tube 19. Tube 19 is packed with a heat conductive material 21 (FIG. 5) such as magnesium oxide (MgO) to provide maximum heat transfer to the tube surface. Thus, the preferred heater is a double loop heater in a cylinder packed with thermally conductive electrical insulation 21 of magnesium oxide or equivalent material. Wound heater geometry (FIG. 22) can also be employed to reduce heater watt density by increasing heat transfer to working fluid which consequently increases operating life.

Figure 23:
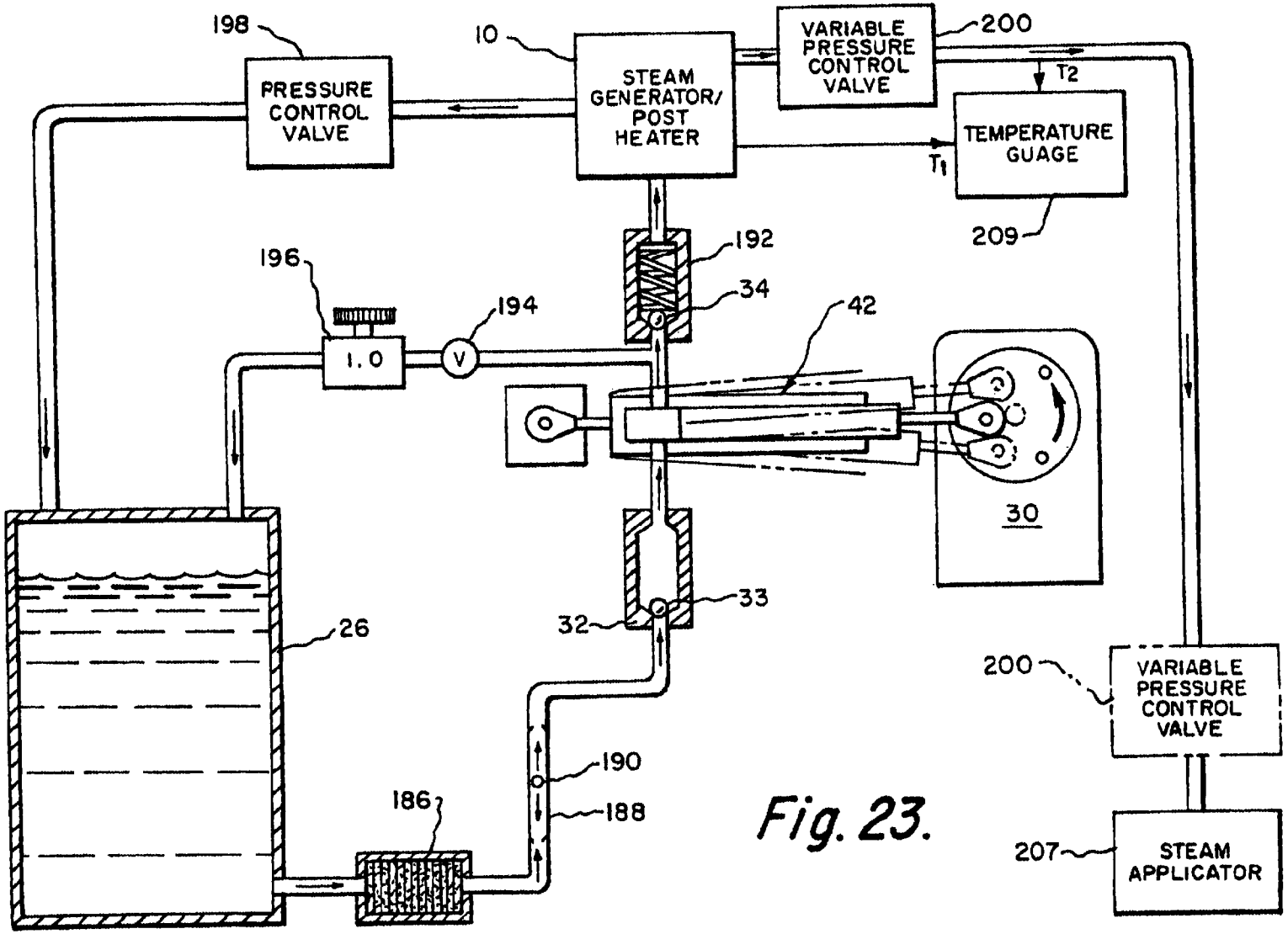
FIG. 23 is a diagram of the fluid flow system illustrating modifications to the steam generating system of FIG. 1.

An optional embodiment of the system for generating steam is illustrated in FIG. 23 where the electronics have been omitted for clarity. In the modification of the system a water filter 186 for filtering particulates and a transparent floating ball flow indicator 188 have been added to the system. Floating ball 190 in flow indicator 188 is arranged to show that fluid is flowing through the system and provides an indication of the volume of flow. Water from reservoir 26 flows through particulate water filter 186 and flow indicator 188 to check valve 32 which is a low pressure check valve. Check valve 32 is a gravity operated check valve or has a very low force spring holding ball 33 against the inlet to the check valve.

Figure 1:
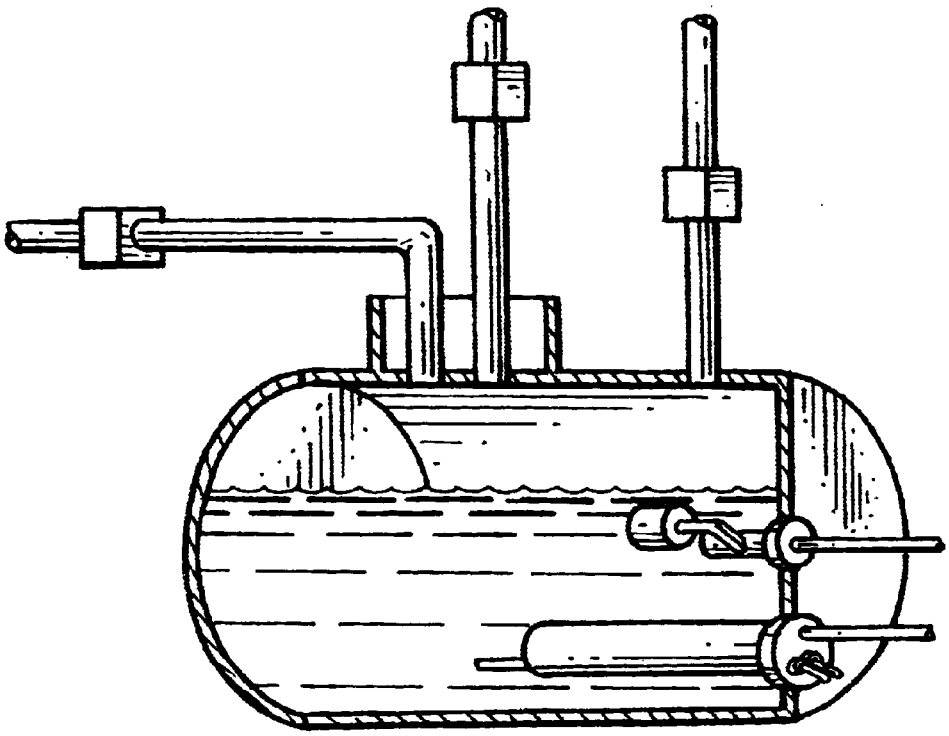
Fig. 1. PRIOR ART
FIG. 1 is a diagram of a conventional steam generating system known in the art.

Outlet check valve 34 is a high-pressure spring activated check valve which includes spring 192 holding the ball against the inlet. Piston pump 42 and motor 30 are the same as illustrated in FIG. 1 and are constructed to deliver water from reservoir to high-pressure check valve 34. The pressure against high-pressure check valve 34 is regulated by gauge 194 and adjustable flow control valve 196. Thus, very accurate low volume flow of water through the system to steam generator can be provided through adjustments of flow control valve 196 with the pressure indicated by gauge 194.

The adjustment of flow control valve 196 increases or decreases the flow of water to steam generator/post heater 10'to control the "wetness" of the steam output. Flow to steam generator/post heater 10' is lowered or decreased to provide for drier steam and increased to increase steam wetness at outlet 14. That is, flow regulator 196 adjusts the flow of water to steam generator 10 by increasing or decreasing the amount of fluid that is bypassed back to reservoir 26. A decrease in the bypass flow increases the flow of water to steam generator/post heater 10' to provide "wetter" steam if desired. Adjusting flow regulator 196 to bypass more water provides "drier" steam.

The system includes a steam bypass or pressure relief valve 198 that bypasses steam back to reservoir 26. The output of steam generator 10 and steam applicator 207. Pressure control valve 200 in combination with steam bypass or relief valve 198 allows precise control of the output from steam generator 10. Preferably variable pressure control valve 200 is located in line 14 at a position that minimizes the drop in temperature of super-heated steam from steam generator 10. If line 14 to applicator 207 is short, variable pressure control valve 200 may be close to the output as shown. In some circumstances such as a long transition through line 14 variable pressure control valve will be located as close as possible to steam cleaning applicator 207 as indicated in phantom at 200' (FIG. 23). It could be in the wand or handle of steam cleaning applicator 207 or even in applicator 207 itself.

The output temperature from steam generator is monitored by switchable or dual temperature gauge 209. Temperature gauge 209 monitors temperature $T_1$ inside steam generator/post heater 10' and temperature $T_2$ outside steam generator in outlet 14 distributing steam to an applicator. Any temperature difference greater than 5° C. indicates there is a problem which should be attended to. Preferably temperature gauge 209 can be switched between temperatures $T_1$ and $T_2$ but could be two separate dual gauges if desired.

Figure 24:
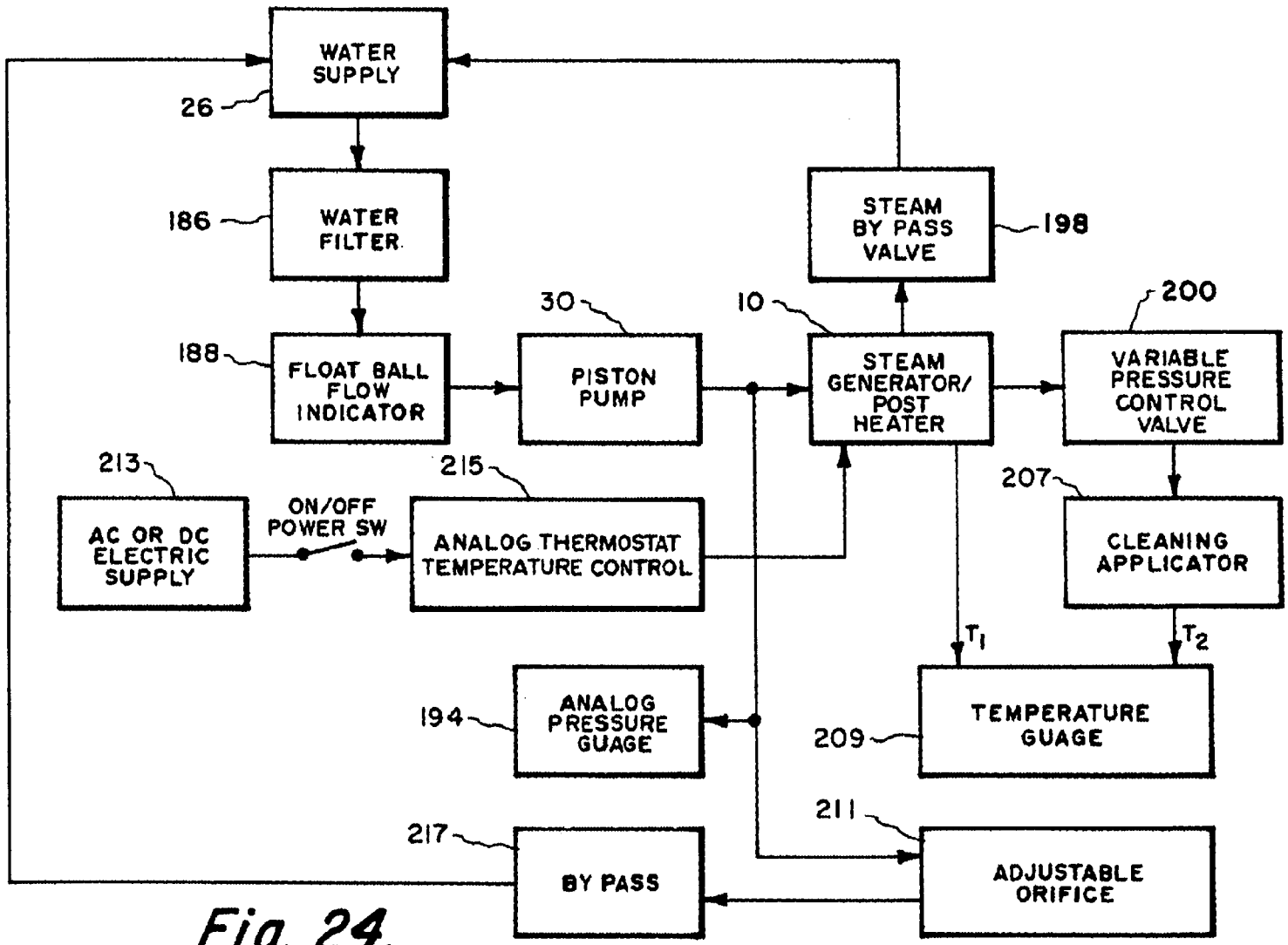
FIG. 24 is a block diagram illustrating the operation of the analog steam generating system of FIG. 23.
Figure 25:
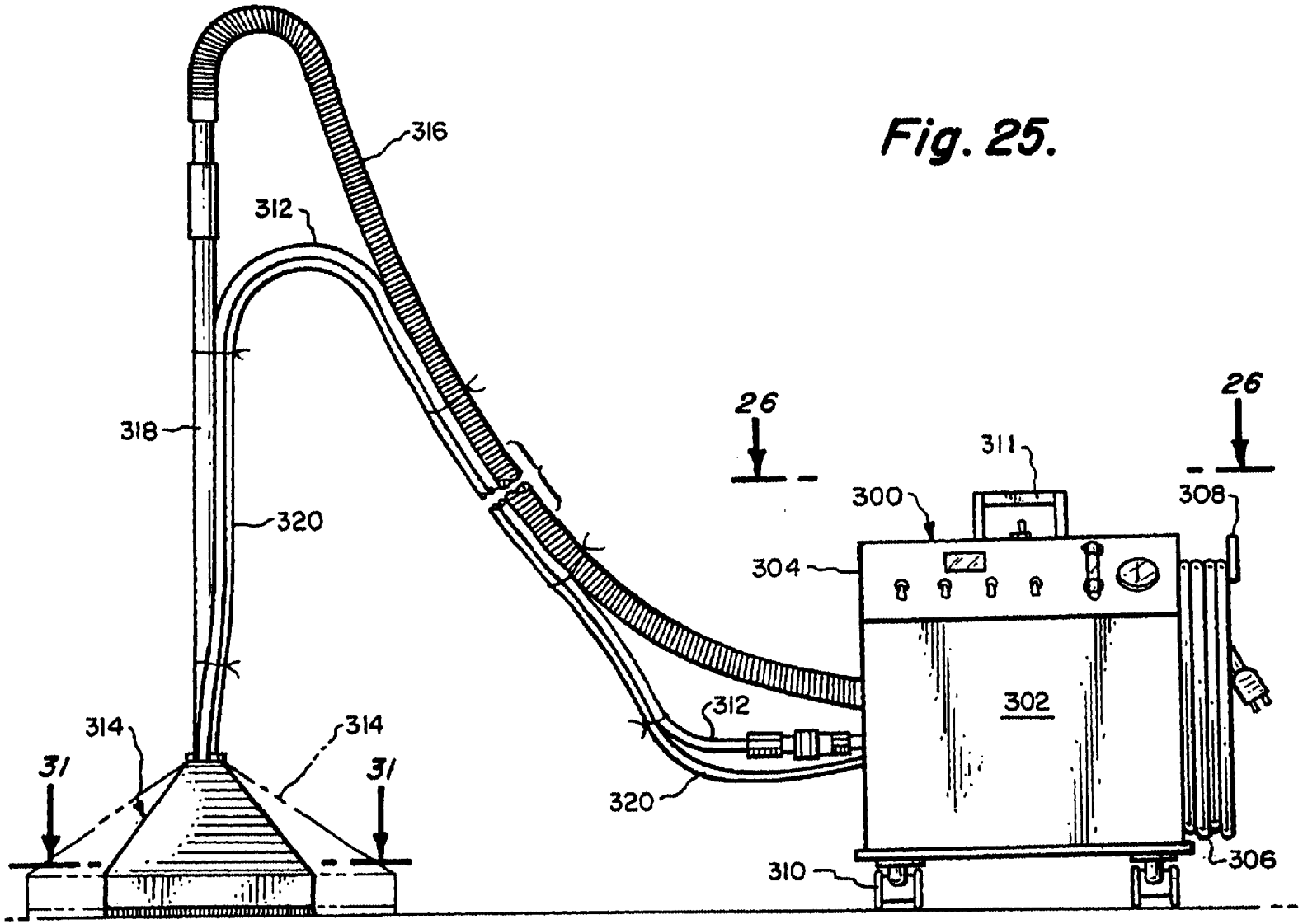
FIG. 25 is a front elevation of a portable cleaning system for cleaning and sanitizing surfaces applying the principles of the invention disclosed herein.

A block diagram illustrating the operation of the analog system in FIG. 23 is shown in FIG. 24. Water is supplied to steam generator/post heater 10' from water supply 26 through water filter 186 and floating ball indicator 188. Flow to steam generator 10 is regulated by analog pressure gauge 194, adjustable orifice 211 and bypass 217 that returns a portion of the flow to water supply 26. Power is applied to steam generator heater 10 from power supply 213 through on/off power switch and analog thermostat temperature control 215. In addition to the bypass system to control the volume of flow, a pressure control system provides protection against excessive pressure. The pressure control system includes a steam bypass valve and returning water to supply system 201 to allow water to flow back to water supply 26 if pressure in steam generator/post heater 10' exceeds the pressure of pressure control valve 203.

Precise control of the output steam generator/post heater 10' is provided by variable pressure control valve 200 between the output from a steam generator/post heater 10' and steam cleaning applicator 207 as described previously. A practical configuration of applicator 207 will be described in greater detail hereinafter. Variable pressure control valves should be located as close as possible to steam cleaning applicator 207 to minimize heat loss. Its position depends upon whether output line 14 is short or long. If line 14 is short then variable pressure relief valve 200 may be close to the outlet from steam generator/post heater 10'. If line 14 is long then variable pressure relief valve 200' (FIG. 23) will be close to steam applicator 207 and may even be in the wand or handle or even steam cleaning applicator 207 itself.

Temperature gauge 209 provides a monitoring system for the output of steam generator/post heater 10'. Temperature gauge 209 can be a dual temperature gauge monitoring temperature $T_1$ of steam in steam generator/post heater 10' as well as temperature $T_2$ output from steam generator either at output 205 or where it is delivered to a cleaning applicator 207.

Thus the analog system disclosed in FIG. 24 provides a constant low volume flow to steam generator with accurate control of the output of steam to cleaning applicator 207. Temperature differences of 5° C. between temperature $T_1$ and $T_2$ indicates there is some problem in the system and it should be shut down and carefully checked. The temperature is checked by switching temperature gauge 209 to read temperature $T_1$ and then to read the temperature $T_2$ at output or at the cleaning applicator 207.

A practical application of the principles disclosed herein for producing a system that generates steam for surface cleaning and sanitation is disclosed in FIGS. 25 through 36. This portable compact steam cleaning system 300 is comprised of a console or housing 302 having a panel 304 having switches for controlling the various functions as will be described hereinafter. An electrical cord for applying AC voltage to the steam cleaning system 306 is mounted on carrier 308. Housing 302 is also mounted on casters 310 so that it can be easily moved about and has a carrying handle 311.

Steam is delivered through hose 312 to applicator 314 (207 of FIG. 24) for applying to a surface to be cleaned. Hose 316 connects applicator 314 through wand 318 for vacuuming debris loosened by the steam cleaning. Electrical cable 320 provides electrical power to sanitizing lamps and applicator 314 as will be described in greater detail hereinafter.

Figure 26:
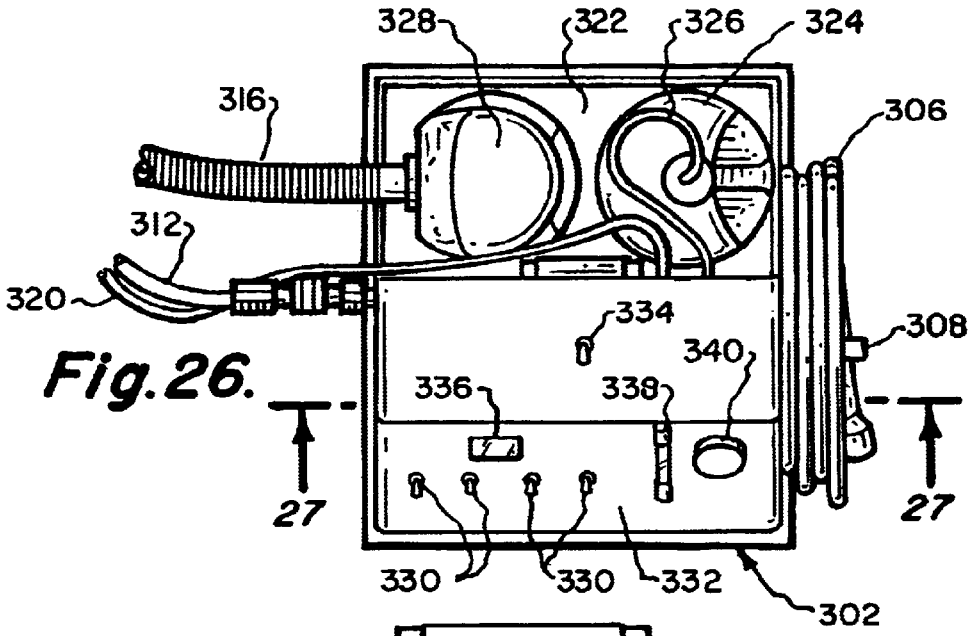
FIG. 26 is a sectional view taken at 26—26 of FIG. 25.
Figure 27:
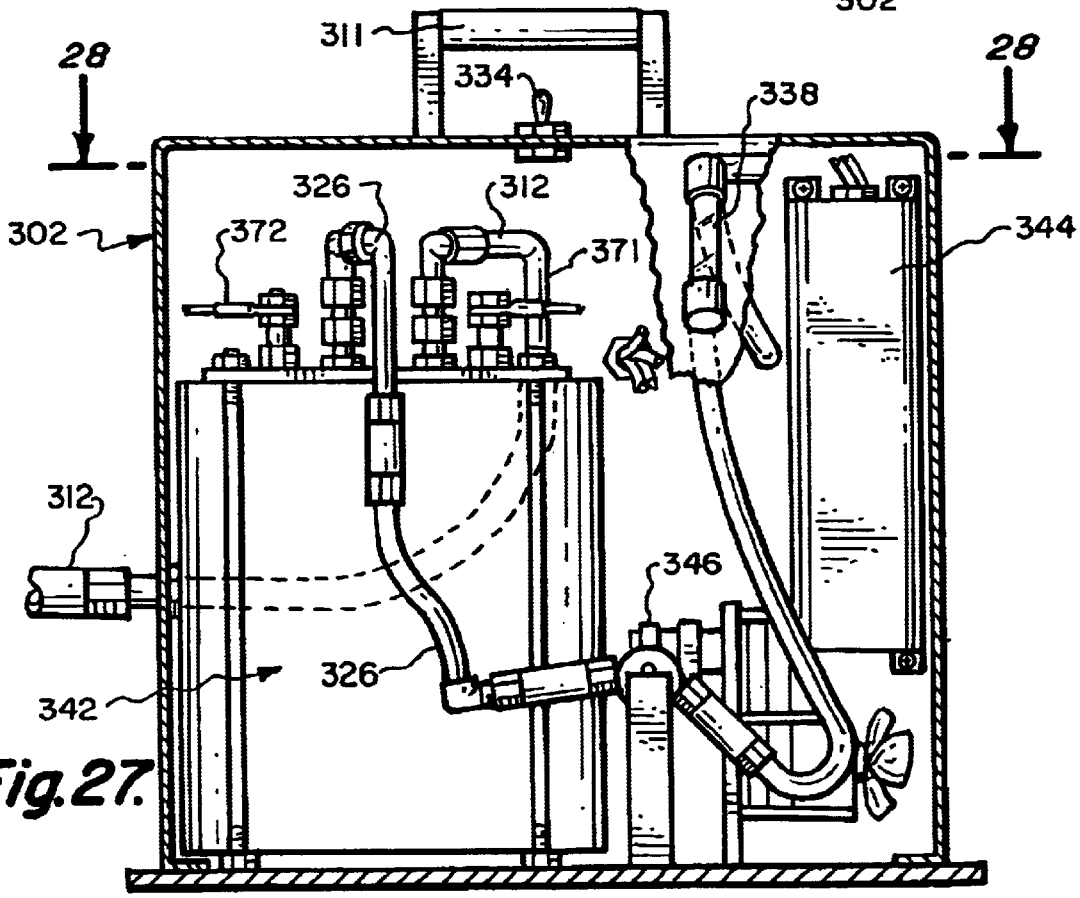
FIG. 27 is a sectional view taken at 27—27 of FIG. 26.
Figure 28:
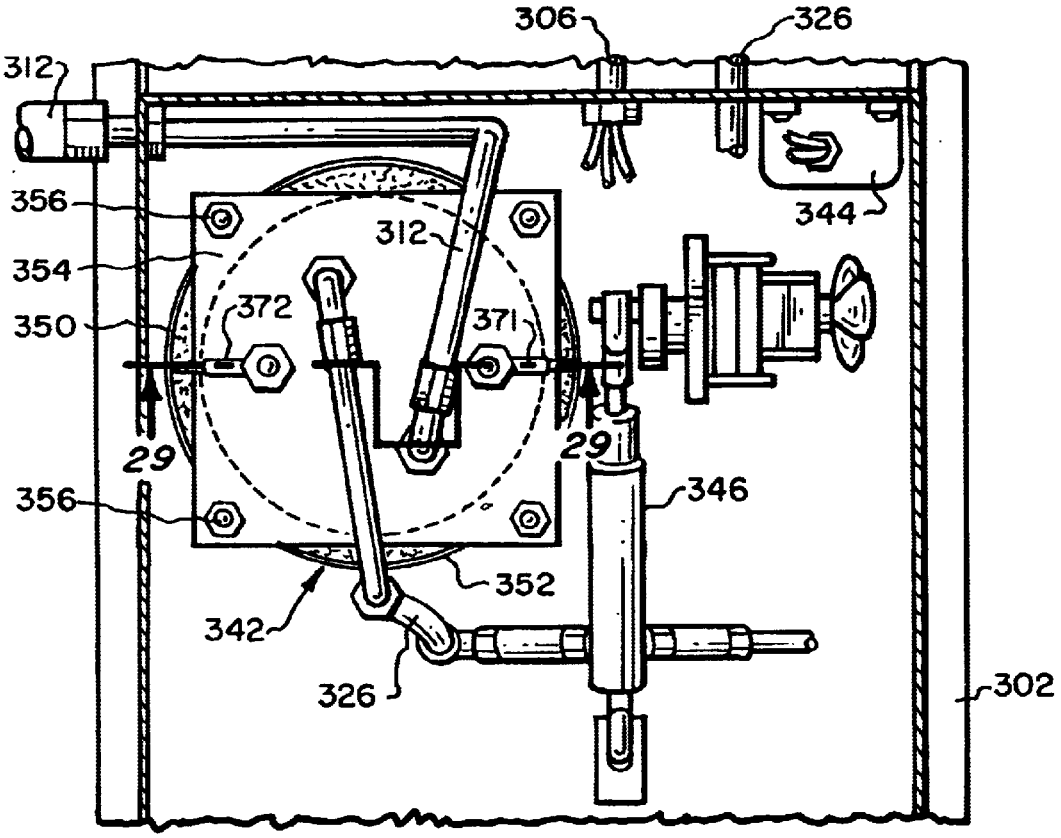
FIG. 28 is a sectional view taken at 28—28 of FIG. 27.

The interior of housing 302 is illustrated in the sectional views of FIGS. 26 through 28. In the top view of FIG. 26 housing 302 has tray 322 for holding a container for supplying water to the steam generator as will be described in greater detail hereinafter. Container 324 can be up to a two gallon container connected by hose 326 to the steam generator through a pump. Vacuum cleaner 328 is also carried in tray 322 for vacuuming up debris loosened from the surface being cleaned.

Toggle switches 330 on the front of a console 332 of housing 302 control the heater for the steam generator, the pump to add water to the steam generator, a post heater in applicator 314 and the vacuum cleaner 328. Switch 334 on top of housing 302 turns sanitizing lamps in applicator 314 on and off. Console 332 also includes a digital display 336, a flow indicating ball valve 338, and a pressure gauge 340 to indicate the pressure in the steam generator.

A vertically oriented steam generating tank 342 for delivering steam to hose 312 and ballast 344 for the sanitizing ultraviolet (UV) lamps in applicator 314 are mounted in housing 302. Pump 346 operated by one of toggle switches 330 continually delivers small volumes of water from container 324 to steam generating tank 342 as described previously.

Figure 29:
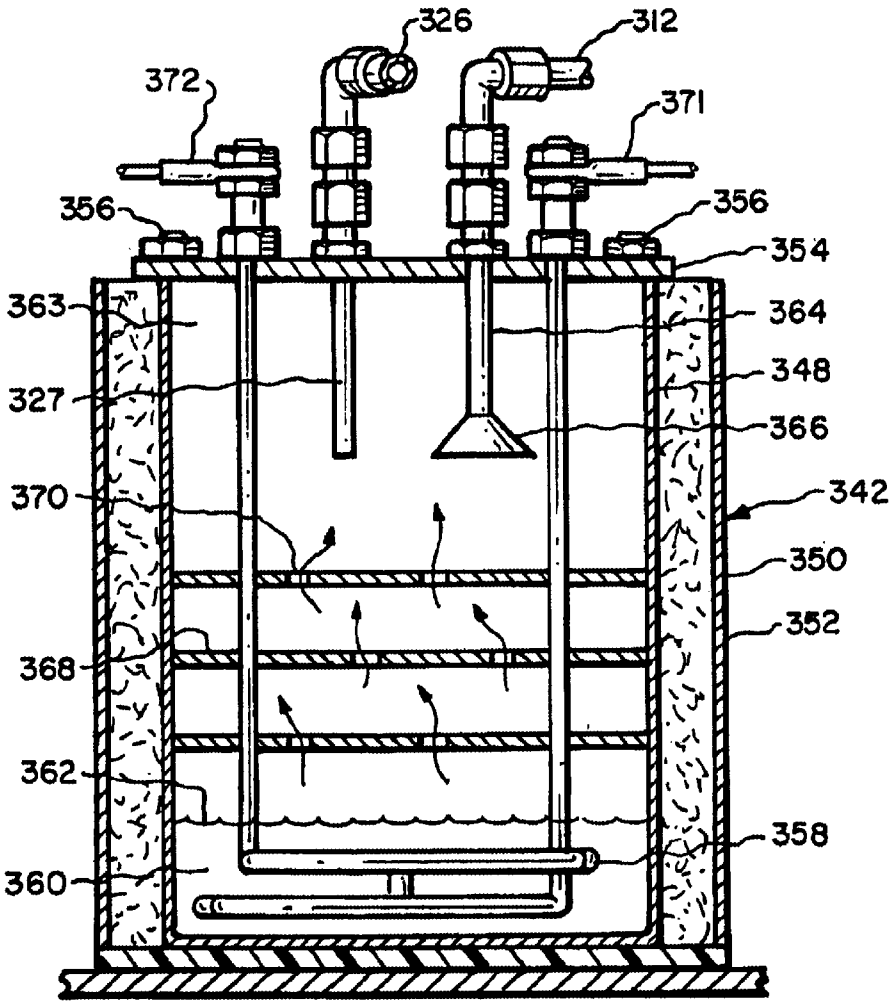
FIG. 29 is a sectional view taken at 29—29 of FIG. 28.
Figure 31:
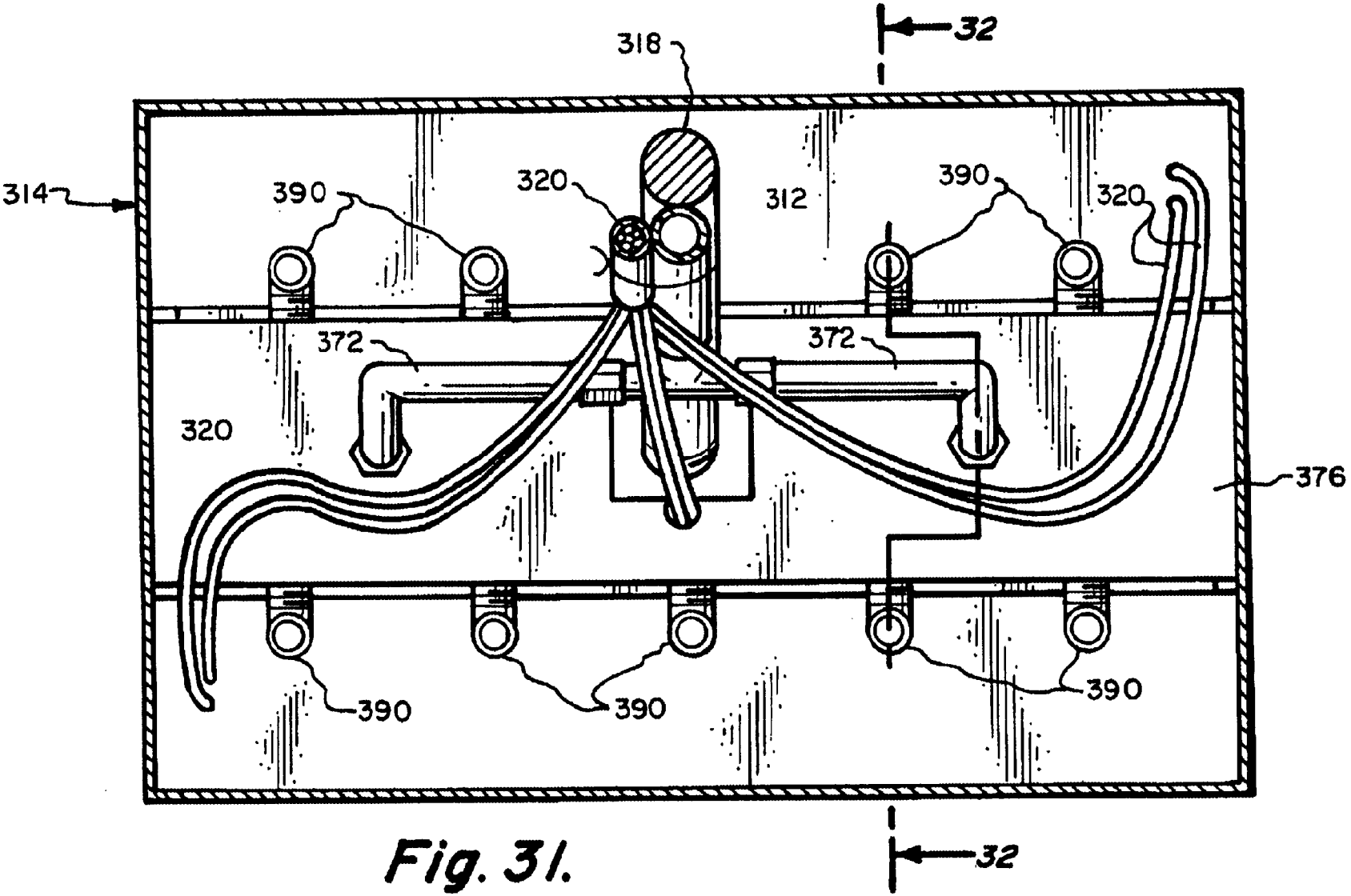
FIG. 31 is a sectional view taken at 31—31 of FIG. 25.

The construction and operation of the steam generator or boiler 342 is shown in the sectional view of FIGS. 28 and 29. Steam generator 342 is preferably a vertically oriented tank 348 that is of somewhat squat design. That is, tank 348 has a height that is equal to or only slightly greater than the diameter. Insulation 350 surrounds tank 348 and is enclosed by outer wall 352. The top of tank 348 is closed by plate 354 securely fastened by bolts 356 at each corner. Preferably tank 348 is constructed of stainless steel.

A double reverse flat immersion heater 358 is provided at the bottom of tank 348. Preferably immersion heater 348 is a flat spiral or helical design that spirals in one direction and then reverses its direction in the second stage. This flat heating element 358 allows the amount of water 360 in tank 348 to be kept to a minimum so that there is a large empty volume above water line 362. Preferably water line 362 never exceeds half the volume of tank 348.

The purpose of this design is to promote the return of water droplets in steam generator back to the water 360 at the bottom of tank 348. Outlet 364 in tank 348 has a conical end 366 which also promotes the separation of water droplets from steam generated inside tank 348. Baffles 368 inside tank 348 have apertures 370 that are vertically misaligned to promote the production of steam and also encourage the separation of water droplets from the steam before it reaches outlet 364. Power is delivered to heater 358 by electrical connections 371 and 372 connected to power cable 306.

Figure 36:
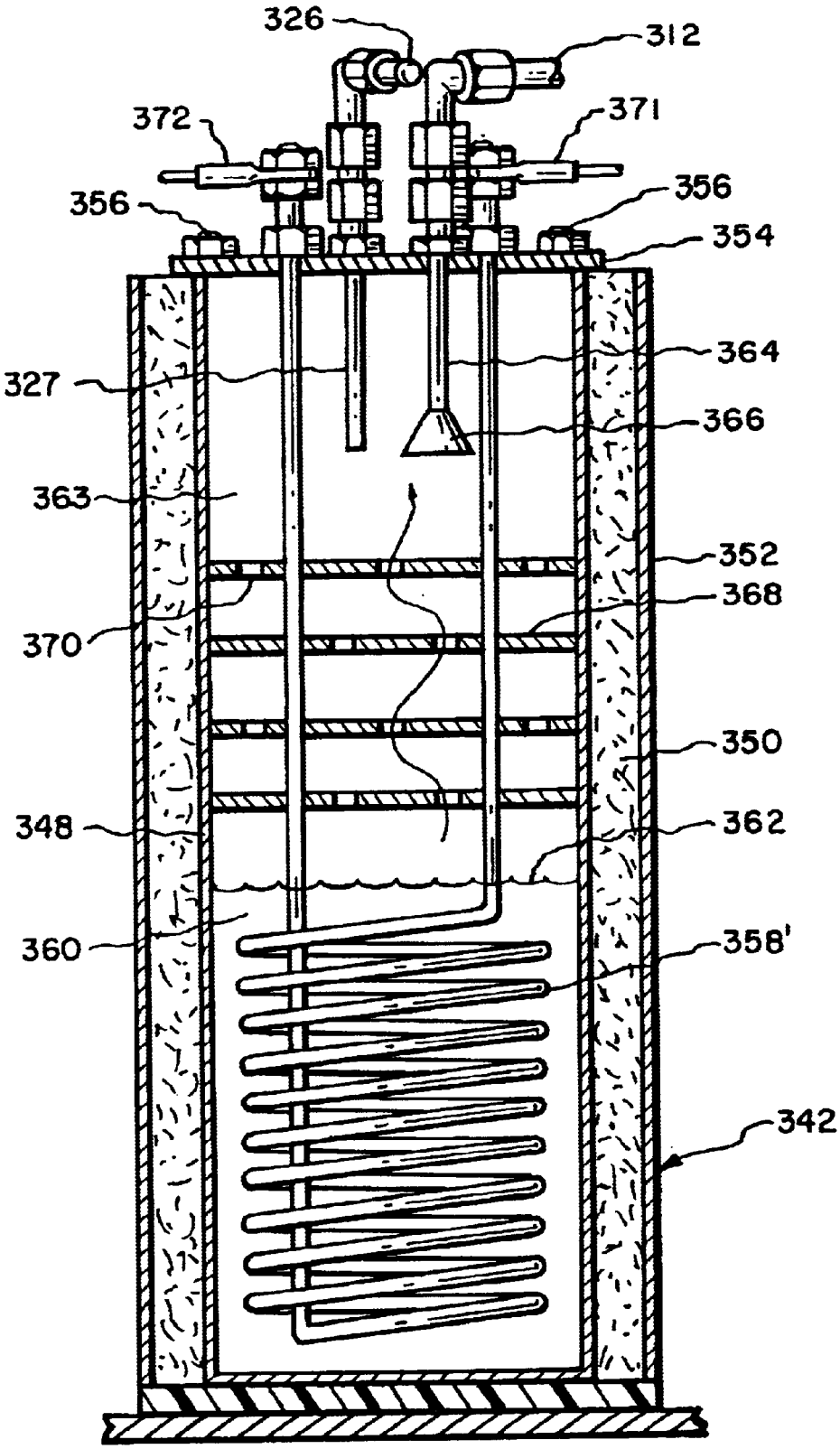
FIG. 36 illustrates an optional embodiment of the boiler used in the steam generating and cleaning and sanitation system of FIG. 1.

An optional construction of boiler 342 is illustrated in FIG. 36. In this optional embodiment, steam generating tank or boiler 342 is,surrounded by insulation 348 and has several baffle plates 368 as previously described. In this case the steam generating tank 342 may be slightly longer. The reason for increasing the length of the tank is to allow use of a standard spiral wound immersion heater 358'. Water 360 is provided at a level 362 to a point above spiral wound immersion heater 358'. This construction is less desirable because of the amount of water 360 that must be in tank 342. Not only does this allow less empty space 363 above the level 362 of water 360 but it also requires a larger volume of water to be heated to produce steam. This can result in greater pressure inside tank 348 than would be desired.

In operation, toggle switches 330 are turned on to begin pumping water through hose 326 to inlet 327 in small bursts as was described hereinbefore. When the water level 362 rises above heater 358, the heater is turned on to begin producing steam. Heater 358 produces steam which rises in tank 348 through apertures 370 in baffles 368 and enters cone 366 on the end of outlet 364. The steam travels through hose or tube 312 to applicator 314 as will be described hereinafter.

Immersion heater 358 is preferably an electrical heater powered by 240 volts AC from power cord 306 and is a flat element hot plate.style having two levels with reverse spirals. As described previously, this allows a minimum amount of water 360 in tank 348. This minimum amount of water allows a large air space above the water line 362 to promote the return of droplets in the steam generator to the bottom of the tank and also minimizes the danger of tank 348 becoming excessively pressurized when heating water 360. Baffles 368 are preferably stainless steel perforated baffles with three baffles being preferred. More or less baffles 368 could be used if desired.

Figure 34:
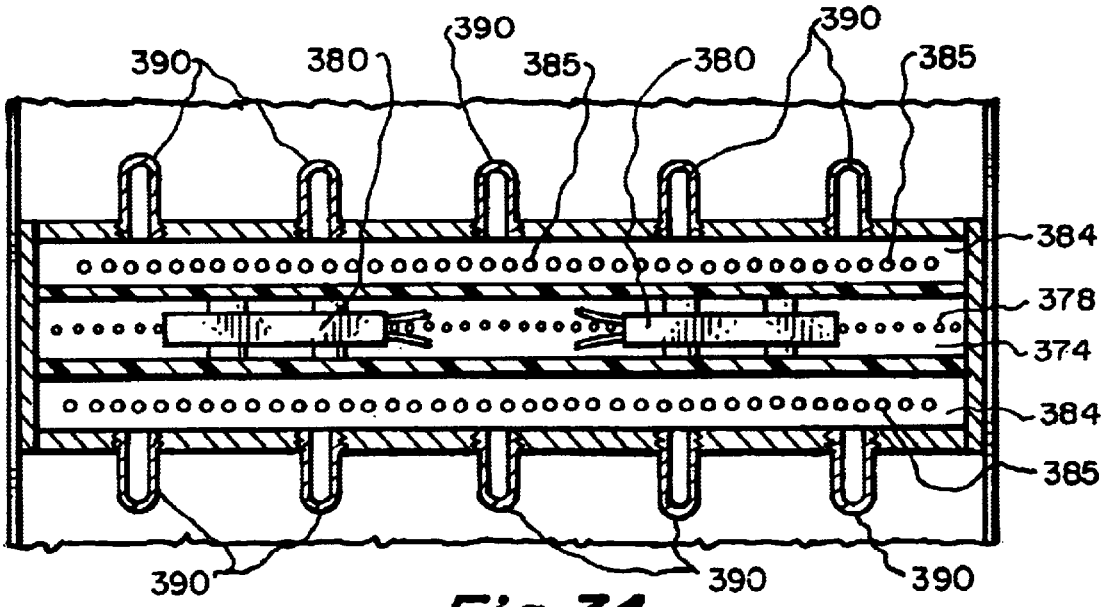
FIG. 34 is a partial sectional view taken at 34—34 of FIG. 32 illustrating the post-super heater.
Figure 30:
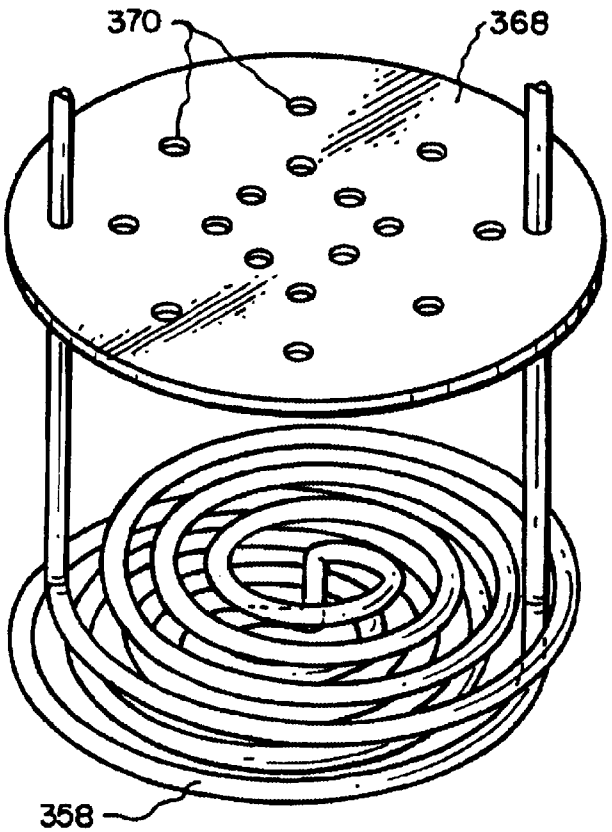
FIG. 30 is a perspective view of a heating element and baffle for use in the boiler illustrated in FIG. 29.
Figure 32:
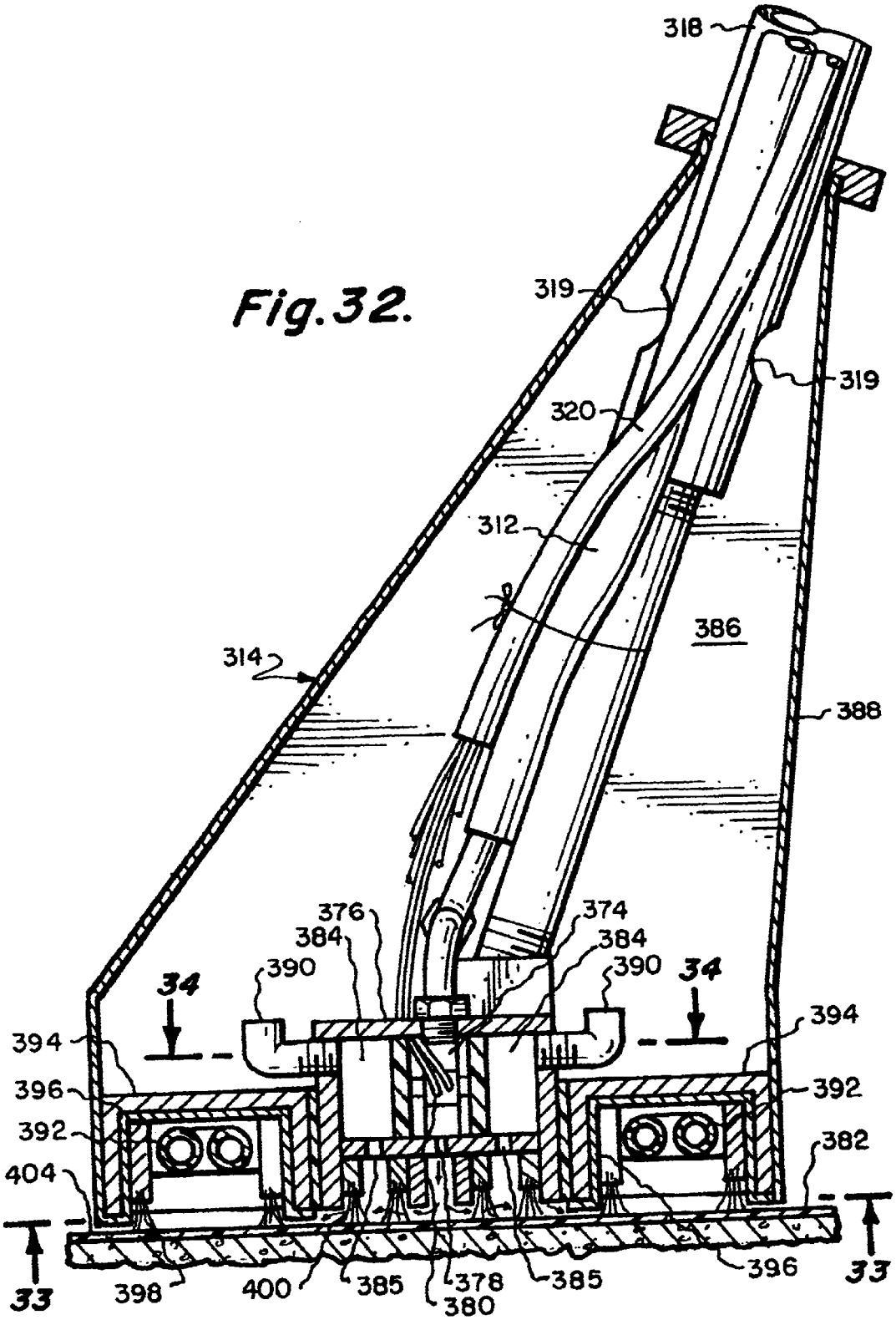
FIG. 32 is a sectional view taken at 32—32 of FIG. 31.
Figure 33:
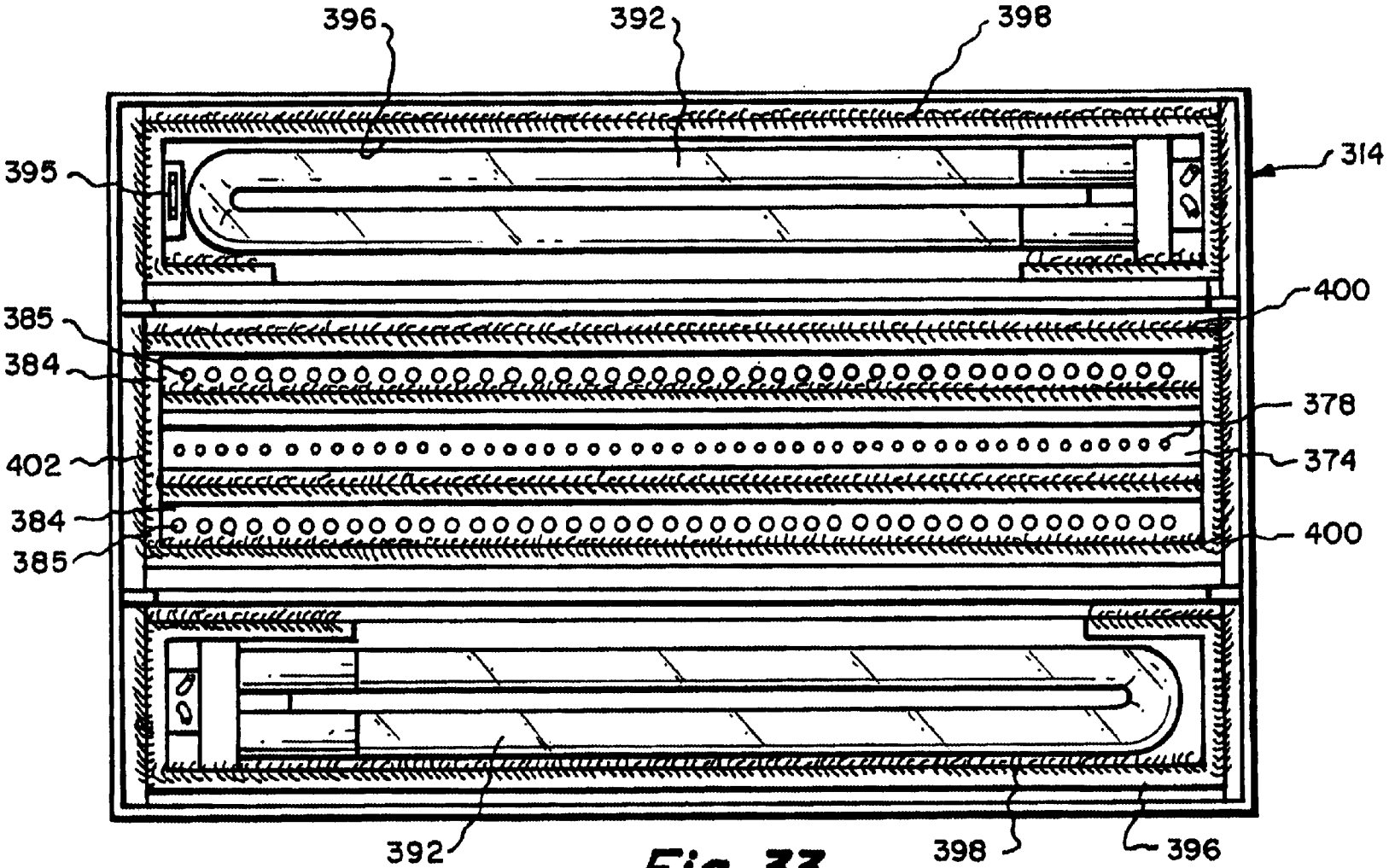
FIG. 33 is a sectional view of the applicator taken at 33—33 of FIG. 32.

A unique applicator 314 is illustrated in the sectional views of FIGS. 32 through 34 where like reference numbers indicates like parts throughout. In top sectional view of FIG. 31, steam delivery hose 312 connects to T-shaped junction 372 which delivers steam to a manifold 374 beneath plate 376. The steam is split into two components by T-connection 372 and is distributed evenly in manifold 374 for exit through a plurality of apertures 378 to spread and deliver the steam evenly over a surface.

In order to maintain the temperature of the steam applied through apertures 378 to a surface, post heaters 380 (FIG. 34) are mounted in manifold 374. Post heaters 380 are mounted in manifold 374 so that the steam surrounds them before exiting apertures 378. Preferably post heaters 380 are bullet cartridge heaters that can be square or rectangular in design and from two to five inches long. Two to four post heaters 380 depending upon the length of the applicator 314 can be used depending upon the size of applicator 314. In the preferred embodiment, applicator 314 is approximately 12 inches wide by six to eight inches wide. Longer applicators can be provided as shown by the phantom line in FIG. 1. In this case, more post heaters 380 would be included in manifold 374.

Debris loosened by the application of steam through apertures 378 to a surface 382 (FIG. 32) is removed by a vacuum applied to manifolds 384 on either side of steam delivery manifold 374. Suction is applied to manifold 384 through the interior 386 of enclosure 388 surrounding applicator 314. The suction is applied through ports 390 of which there are five connected to manifold 384 on each side. Vacuum 328 draws the loosened debris into manifold 384 through suction apertures 385 out through ports 390 and into wand 318 through holes 319 for removal and disposal. Suction is constantly applied by vacuum 328 to hose 316 and wand 318 to draw debris from surface 382 through manifold 384 into interior 386 of housing 388.

A unique aspect of this invention is that it not only cleans and removes debris and contamination from surfaces 382, it will also sanitize the surface simultaneously. Most cleaning systems only loosen and pick up the debris and contamination of the surface still leaving much of it on the surface. In some cases, they merely push the debris around and with heavy germicidal liquids do manage to kill some of the contaminating bacteria. The present invention not only loosens and dissolves surface contaminants which are physically removed by the vacuum system, but it also sanitizes the area with the application of germicidal bacterial destroying energy.

Sanitizing is provided by mercury vapor ultraviolet (UV) high-intensity lamps 392 mounted on either side of steam delivery manifold 374 and vacuum manifold 384. Preferably the ultraviolet lamps are high-intensity lamps that provide shortwave (254 nm) ultraviolet energy for complete destruction of thirty or more bacteria organisms, five or more yeast organisms, up to ten types of mold spores, and three or more viruses and protozoa.

The amount of energy measured in microwatt seconds per centimeters for destruction of these various organisms can vary from 1,000 microwatt seconds per square centimeter to 330,000 microwatt seconds per centimeter. For this reason ultraviolet lamps 392 are high energy or intensity lamps that are positioned in mountings 394 that run parallel with the steam delivery manifold 374 and suction or vacuuming manifold 384 and are close to surface 382 being cleaned. Because the high intensity lamps can present some danger if exposed to a person's eye, a microswitch 395 mounted in applicator 314 will shut down lamps 392 when lifted some distance off the surface being cleaned.

Ultraviolet sterilizing lamps 392 are preferably U-shaped lamps having a length of approximately ten inches that can have a wattage of greater than ten and microwatts at one meter also greater than ten. This substantially increases the closer that ultraviolet high-intensity sanitizing lamps 392 are to surface 382. Such lamps are available from Atlantic Ultraviolet Corporation of Hauppauge, N.Y., and Pro-Mark Engineered Systems of Ft. Lauderdale, Fla. The higher the intensity of lamps 392 on surface 382, the less time it takes to substantially destroy the maximum amounts of organisms contaminating the surface. For this reason, an additional feature is the provision of reflectors 396 inside mounting 394 supporting high-intensity ultraviolet lamps 392. This concentrates the intensity of lamps on the surface 382 allowing a destruction of the maximum amount of organisms in just a few seconds. Applicator 314 is moved over surface 382 slowly which provides time for sanitizing high-intensity ultraviolet lamps 392 to destroy most organisms that contaminate the surface.

An additional feature is the inclusion of brushes 398 around ultraviolet high-intensity lamps 392 and also brushes 400 and 402 surrounding vacuum manifold 384 and steam delivery manifold 374 respectively. Brushes serve to help loosen and trap debris in the particular section of the applicator for removal and sanitizing.

The operation of the device and method of cleaning vacuuming, and sanitizing the surface is illustrated in the diagrams of FIGS. 35*a* through 35*d*. Tank or boiler 342 is first filled with water sufficient to cover flat spiral heater 358. Immersion heater is then energized by one of toggle switches 330 to begin heating water 360 to produce steam. Steam is generated and flows through apertures 370 in baffle plates 368 to outlet 364 for delivery to hose 312 to applicator 314. Hose 312 is connected to steam application manifold 374 for delivery through a plurality of ports or apertures 378 to surface 382. Post heaters 380 maintain a temperature of the live steam impacting surface 382 at 212° Fahrenheit to 230° Fahrenheit or more to loosen and dissolve surface contaminants or debris 404 on surface 382.

Figure 35A:
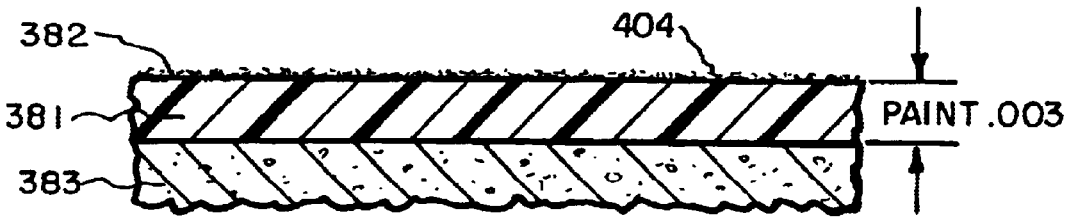
FIGS. 35*a* through 35*d* illustrates the operation and application of steam for cleaning and sanitation of a surface.
Figure 35B:
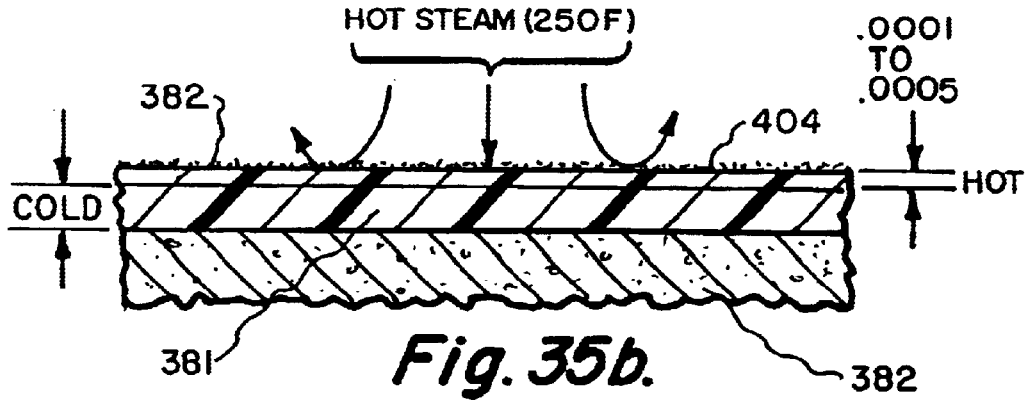
Figure 35C:
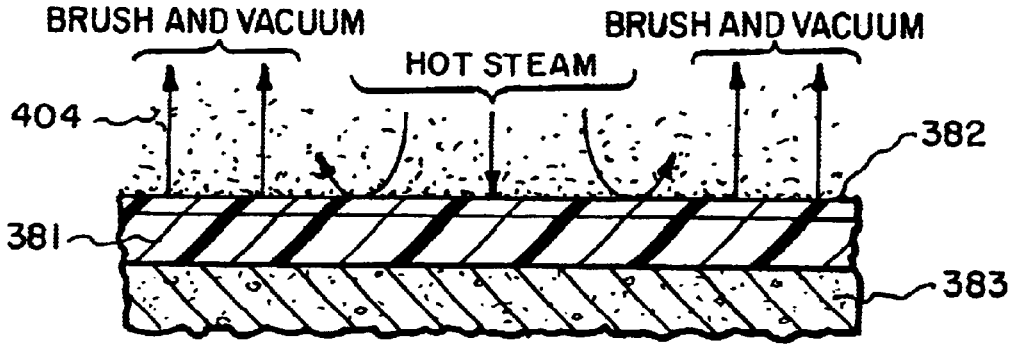

Surface 382 will generally be a floor or other surface of concrete 383 covered by paint 381 or other durable material. Hot, live steam impacts surface 382 to loosen and dissolve surface contaminants 404. The surface contaminants 404 are then physically removed from the original surface and suspended (trapped) as shown in FIG. 35*c* in a reduced volume of hot air and steam and a matrix of brush fiber from brushes 398, 400, and 402 by surface scrubbing and collection via mutual particle attraction. Concentrated conglomerate of dirt, mud, bacteria is then subjected to a vacuum through vacuum manifold 384 and transported to a holding chamber (not shown) in vacuum 328 for collection and disposal.

Figure 35D:
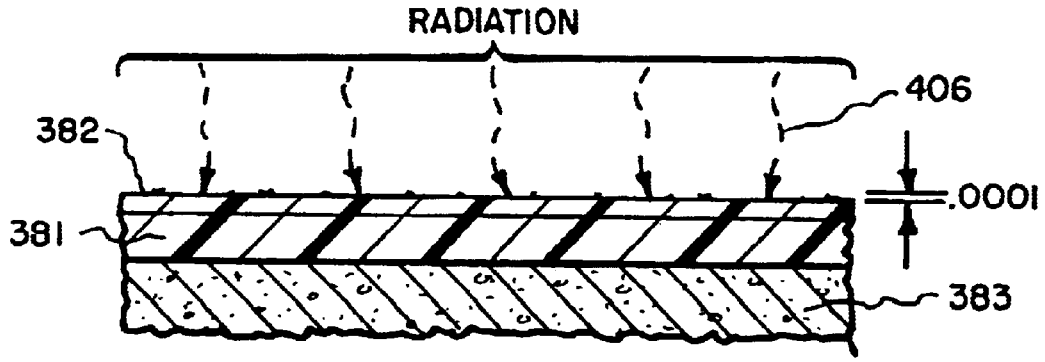

This process of steam heating, concentration of contaminants and collection of contaminants is done in a continuous manner to arrive at a so-called "clean surface". This surface may be physically clean however the surface is not sanitary because of the multitude of bacteria, mold spores, viral contaminants that populate the "clean surface". This invention automatically applies a fourth level of surface cleaning (i.e., sanitation) via intense mercury vapor radiation ultraviolet lamps 392 that bombard target surface 382 as illustrated in FIG. 35*d*.

Radiation 406 bombards the surface at a primary radiation wavelength of 254 nm. Other wavelengths of course can be employed for specific affects as required. This particular high-intensity wavelength was chosen because it is one of the wavelengths that delivers the maximum amount of bacteria and organism destruction. Multiple intense mercury vapor beam ultraviolet lamp light is applied by two lamps 392 on either side of the area where steam is applied. This multiple application of high-intensity ultraviolet light insures maximum obliteration of all contaminants sensitive to the radiation wavelength. Thus the operational surface cleaning of the system consists of four independent processes, 1. hot live steam impact; 2. physical brush scrubbing of the target surface; 3. vacuum removal of contaminated debris; and 4. intense radiation of clean surfaces to destroy remaining chemical and biological contaminants in a continuous coordinated attack. The steam and brush cleaning plus the vacuum removal of debris are important steps to insure a thin (i.e., less than 0.005 thick) contaminated film is presented to the high-intensity ultraviolet mercury vapor radiation. A film that is too thick may prevent the radiation from completely penetrating it to the surface of the target body which can then leave a thin active biological layer which would in turn allow a bacterium film to re-form.

Thus there has been described a system for practical application of the steam generating invention described and disclosed herein. The system is unique in that it is compact and portable and extremely safe. It heats very small volumes of water to produce live, hot steam. Steam cleans and loosens debris, vacuums or suctions debris for disposal but also includes a sanitizing system and high-intensity mercury vapor ultraviolet lamps that destroys a substantial amount of bacterial organisms.

Thus, there has been disclosed a steam generating system that provides a number of operational and advantageous features and safety characteristics. The water supply volume can be unlimited because, the system could be attached to any size reservoir or directly to a hose input. The system can heat the fluid in as short a time as one minute from a cold start because of the low residual fluid volume contained in heat tube 10 at any given time. Another operational feature is a "warm" stand-by mode in which the pump is turned off and the heater is left on, but at a very low wattage such that the heater tube and baffle system are maintained at approximately 150° F. for rapid (≈30 sec) ramping up to 300° F. for instant steam generation. Steam cylinder 10 is typically three inches in diameter with a 0.035 wall thickness providing a rupture safety factor of better than thirty nine (39).

A major design feature of the system is the continuous flow through the steam generating pump and baffle heating process. For example, the pump piston actuation arm can provide a continuous water injection rate into the steam generating cylinder of approximately 0.02 gallons per minute. In a steady state condition, the same weight of steam is ejected out of the steam tube outlet 14 as is injected by one cycle of the pump piston, which is approximately $1\times10^{-4}$ gallons of water or $8.3\times10^{-4}$ lbs of steam. Thus, the design is inherently safe in that the maximum steam available to expand in steam cylinder 10 is only $8.3\times10^{-4}$ lbs of steam at 150 PSI and 300° F. versus 6.2 lbs of steam per prior art for a steam source reduction ratio of 6.2 over $8.3\times10^{-4}$=7500:1. Clearly the small weight and volume of the steam contained in this small open ended tube steam generating system 10 of this invention poses no threat of personal injury due to escaping steam.

This invention is not to be limited by the embodiment shown in the drawings and described in the description which is given by way of example and not of limitation, but only in accordance with the scope of the appended claims.

What is claimed is:

1. A steam cleaning and sanitizing system comprising;

a compact portable housing;

a vertically oriented steam generating tank in said housing;

a flat spiral immersion heater at the bottom of said tank;

an applicator connected to said steam generator in said housing, said applicator including outlets for applying steam to a surface to be cleaned;

a vacuum to remove debris loosened by said steam, and a sanitizer for applying sanitizing energy to said surface simultaneously with said steam cleaning and vacuuming;

whereby a surface is steam cleaned, vacuumed, and sanitized simultaneously.

2. The system according to claim 1 in which said steam generating tank in which said flat spiral immersion heater is constructed and arranged so that the volume of water to cover said immersion heater is less than about one-half the volume of said steam generating tank.

3. The system according to claim 2 including a plurality of baffles in said tank; said plurality of baffles promoting the separation of water droplets from wet steam.

4. The system according to claim 3 wherein said steam generating tank has an outlet at the top and a cone on an end of said outlet to precipitate water droplets in said steam exiting said outlet.

5. The system according to claim 1 wherein the height of said steam generating tank is equal to or slightly larger than the diameter of said steam generating tank.

6. The system according to claim 1 wherein an empty space above said immersion heater in said tank is equal to or greater than one-half the volume of said tank thereby promoting the separation of water droplets from wet steam.

7. The system according to claim 6 in which the volume of water in said steam generating tank is just sufficient to cover said heater.

8. The system according to claim 1 in which said compact portable housing has a tray; said tray adapted to removably carry a vacuum cleaner and a supply of water in a container.

9. The system according to claim 1 in which said applicator is connected to said steam generating tank for applying steam to a surface to be cleaned.

10. The system according to claim 9 in which said applicator is connected to said steam generator by an insulated hose.

11. The system according to claim 10 in which steam delivered to said applicator is applied through a manifold in said applicator.

12. The system according to claim 11 in which said steam manifold includes a plate having a plurality of apertures for evenly distributing said steam to a surface to be cleaned.

13. The system according to claim 12 including one or more post heaters in said steam manifold for maintaining the temperature of said steam delivered to said surface to be cleaned.

14. The system according to claim 13 in which said post heater comprises at least two cartridge heaters mounted adjacent inlets in said steam manifold.

15. The system according to claim 14 including a vacuuming apparatus for removing debris loosened from said surface to be cleaned.

16. The system according to claim 15 in which said vacuuming apparatus comprises a vacuum cleaner removably carried in a tray on said compact portable housing; a vacuum manifold in said applicator; and a vacuum hose connecting said vacuum manifold to said vacuum cleaner carried in said tray.

17. The system according to claim 16 in which said applicator is connected to a hollow wand for use as a handle for manipulating said applicator; said vacuum hose being a flexible hose connected between said wand and said vacuum cleaner carried in said tray.

18. The system according to claim 17 in which said vacuum manifold in said applicator comprises a pair of vacuum manifolds on either side and parallel to said steam manifold.

19. The system according to claim 18 in which each of said vacuum manifolds has a plurality of outlet ports for extracting debris in an enclosure; said enclosure surrounding said applicator at one end and being connected to said wand at an opposite end.

20. The system according to claim 19 including a germicidal sanitizer for sanitizing the surface area being cleaned to destroy harmful organisms.

21. The system according to claim 20 in which said germicidal sanitizer comprises at least one germicidal lamp for illuminating the surface area being cleaned.

22. The system according to claim 21 in which said at least one germicidal lamp comprise a pair of germicidal lamps.

23. The system according to claim 22 in which said germicidal lamps are mercury vapor ultraviolet (UV) lamps.

24. The system according to claim 23 in which said UV lamps emit UV radiation at a wavelength of about 254 nm.

25. The system according to claim 24 in which said UV lamps are U-shaped UV lamps mounted in said applicator on opposite sides of said steam manifold.

26. The system according to claim 25 including a reflector mounted behind each UV lamp to increase the intensity of the UV radiation on the surface being cleaned.

27. The system according to claim 26 including a safety microswitch mounted in said applicator for turning said UV lamps off when said applicator is lifted off a surface being cleaned.

28. The system according to claim 27 including scrubbing elements for scrubbing said surface being cleaned for dislodging debris loosened by the steam from said applicator.

29. The system according to claim 28 in which said scrubbing elements comprises brushes around the periphery of said applicator.

30. The system according to claim 29 in which said brushes surround the periphery of said steam manifold, said vacuum manifold and said UV lamps.

* * * * *

UNITED STATES PATENT AND TRADEMARK OFFICE

CERTIFICATE OF CORRECTION

PATENT NO. : 6,647,204 B1
DATED : November 11, 2003
INVENTOR(S) : Harold D. Hutchinson It is certified that error appears in the above-identified patent and that said Letters Patent is hereby corrected as shown below:

Column 2,
Line 10, after "welded end", delete ".";
Line 42, after "provide unlimited", delete ".";
Line 54, after "that is inherently", delete ".";

Column 3,
Line 39, after "heat steam and", delete ".";

Column 10,
Line 12, after "positioned in", delete ":";

Column 11,
Line 46, "D diameter" should be -- D=diameter --;
Line 47, "L length" should be -- L=length --;

Column 13,
Line 16, after "super-heated steam", delete ".";

Column 18,
Line 11, after "boiler 342 is", delete ",".

Signed and Sealed this

Twenty-second Day of June, 2004

JON W. DUDAS
*Acting Director of the United States Patent and Trademark Office*